US006422271B1

(12) United States Patent
Mitchell et al.

(10) Patent No.: US 6,422,271 B1
(45) Date of Patent: Jul. 23, 2002

(54) APPARATUS AND METHOD FOR MAKING CLAMP RINGS

(75) Inventors: Gordon P. Mitchell; Daniel L. Frick, both of Merrill, WI (US)

(73) Assignee: Mitchell Metal Products, Inc., Merrill, WI (US)

( * ) Notice: Subject to any disclaimer, the term of this patent is extended or adjusted under 35 U.S.C. 154(b) by 0 days.

(21) Appl. No.: 09/679,206

(22) Filed: Oct. 4, 2000

(51) Int. Cl.[7] ..... B21F 15/08
(52) U.S. Cl. ..... 140/71 R; 140/112
(58) Field of Search ..... 72/432, 453.02; 140/71 R, 112

(56) References Cited

U.S. PATENT DOCUMENTS

| | | | | |
|---|---|---|---|---|
| 378,893 | A | 3/1888 | McIntyre | |
| 1,617,188 | A | 2/1927 | Woerner | |
| 1,729,171 | A | 9/1929 | Lavley | |
| 1,796,899 | A | 3/1931 | Smyser | |
| 1,799,526 | A | 4/1931 | Nylander | |
| 2,487,475 | A | 11/1949 | Powers | |
| 2,740,218 | A | 4/1956 | Miller | |
| 3,008,496 | A | 11/1961 | Goddard | |
| 3,050,890 | A | 8/1962 | Bloch | |
| 3,160,890 | A | 12/1964 | Lefebvre | |
| 3,194,935 | A | * 7/1965 | Stoeckel | 140/112 |
| 3,327,739 | A | 6/1967 | Harper | |
| 3,330,306 | A | 7/1967 | Rudd | |
| 3,608,885 | A | 9/1971 | Roth | |
| 3,780,514 | A | 12/1973 | Rodermund et al. | |
| 4,277,885 | A | 7/1981 | Scudder | |
| 4,335,758 | A | 6/1982 | Williams | |
| 4,609,989 | A | 9/1986 | Squarci | |
| 4,802,271 | A | 2/1989 | Bader | |
| 4,964,932 | A | 10/1990 | Miller | |
| 5,207,758 | A | 5/1993 | Royalty | |
| 5,247,729 | A | 9/1993 | Carmichael | |
| 5,255,421 | A | 10/1993 | Kamysiak | |
| 5,829,490 | A | * 11/1998 | Kilbane | 140/112 |
| 5,896,638 | A | 4/1999 | Kamysiak | |
| 5,955,018 | A | 9/1999 | Prime | |

* cited by examiner

*Primary Examiner*—Lowell A. Larson
(74) *Attorney, Agent, or Firm*—Michael Best & Friedrich LLP

(57) ABSTRACT

Preferred embodiments of the present invention employ a clamp ring apparatus having an upper die assembly with an upper die, a lower die assembly with a lower die, an actuator for bringing the upper die assembly and the lower die assembly together, a leg deflection element for offsetting legs of clamps formed by the apparatus, and a spring for controlling welding pressure on the wires formed to make the clamp rings (for those embodiments in which the wires are welded together). Spine and rib wires are fed into the apparatus from respective wire supplies, and are preferably brought into overlapping relationship between the upper and lower die assemblies. The upper and lower die assemblies then compress the wires to form a clamp from the rib wire and to attach the wires together preferably by using welding electrodes at or adjacent to the lower die assemblies.

56 Claims, 11 Drawing Sheets

APPARATUS AND METHOD FOR MAKING CLAMP RINGS

FIELD OF THE INVENTION

The present invention relates to clamp rings, and more particularly to devices and methods for automated production of clamp rings.

BACKGROUND OF THE INVENTION

Clamp rings have become a popular device for creating wreaths and similar items. As is well known, clamp rings typically have a spine in the shape of a ring to which are attached a number of spaced clamps used for holding material (e.g., boughs, decorations, and the like) to the ring. The spine and clamps are usually made from wire, with the spine wire normally being of a heavier gauge than the wire used to make the clamps (often called "rib" wire). The spine therefore provides sufficient strength and rigidity to the wreath while the clamps can be bent around material to be held to the spine. The clamps can be bent by hand, by a pair of pliers or other hand tool, or by a machine adapted for bending the clamps about the material to be held. Although a number of different clamp shapes exist, clamps are typically U-shaped with two legs and a back attached to the spine. Typically, the clamps are welded to the spine in any conventional manner.

As a result of the popularity of the above-described wire clamp ring, various devices and methods have been developed for producing such clamp rings more rapidly and reliably. One such device is disclosed in U.S. Pat. No. 5,829,490 issued to Kilbane. In the Kilbane device, a spine wire and a rib wire are fed perpendicularly to one another between male and female dies and adjacent to an anode in the male die. By actuation of a pneumatic cylinder, the female die is moved toward the male die, thereby cutting the rib wire and bending the rib wire into a U-shape between the dies to form a rib (a clamp) of the clamp ring. After this movement, a second pneumatic cylinder is actuated to bring a welding electrode into contact with the crossed rib and spine wires. An electrical current passed through the electrodes and wires then welds the rib wire to the spine wire. Next, both pneumatic cylinders retract to permit the spine wire and rib to be moved out from between the dies in preparation for the next rib forming and welding cycle. Because the spine wire fed to the dies is bent in an arc, a ring is eventually produced having the desired spaced-apart clamps welded thereto. After the ring is completed, the spine wire is cut and the wire clamp ring can be completed by welding the ends of the ring together.

Although conventional clamp ring manufacturing devices represent a significant improvement over manual assembly of clamp rings, they are not without their shortcomings. Significant factors in the success of clamp ring manufacturing device designs are the speed at which the devices can operate, the reliability of the ring-to-clamp connections made, the lifespan of the device, the manufacturing and maintenance costs of the device, and the ability of the device to produce different types of clamp rings. However, conventional clamp ring manufacturing devices fail to perform well in the majority of these areas.

For example, a common problem in the production of ring clamps is poor rib wire to spine wire attachment. In many instances, a rib falls off of the spine immediately after the welding operation is performed or soon thereafter. However, more serious problems can occur when the rib is partially attached to the spine and passes to the end user, who breaks the clamp off of the spine while attempting to manipulate the clamp. The partially-finished wreath is typically thrown away without disassembly, representing a waste of end user material and time. Even a small number of poor welds can frustrate the customer enough to return an entire shipment of clamp rings to the manufacturer. Therefore, the need to consistently and strongly attach clamps to the spine of the clamp ring is highly important.

The need for rapidly producing ring clamps is often at odds with the need to produce quality clamp welds. Specifically, weld quality in many prior art machines can drop significantly at faster machine speeds.

A source of clamp-to-spine attachment problems is the need to precisely control welding variables such as temperature, pressure, and welding time. In the conventional electrical welding systems commonly used in clamp ring manufacturing devices, the pressure at which the spine and rib wires are held against the electricity-supplying electrodes is important to creating a proper weld. However, because the actuator used must be strong enough to bend and form rib wires into clamps (e.g., into U-shaped clamps), the ability to precisely control actuator force is at odds with the use of larger, more powerful, and less precise actuators. The result is either less control over welding pressure or the inclusion of a second more precisely controllable actuator such as that employed in the device disclosed in the Kilbane patent mentioned above. Less control over welding pressure can result in poorer welds, while the addition of a second actuator adds complexity and expense to the device.

Due to the cyclical motion of clamp ring manufacturing machines and their often constant operation, the chances of machine breakdown can be high. As noted in the Kilbane patent mentioned above, repeated torque loads can be imparted to the actuation device and can cause premature failure of the actuation device. Structure added to counteract destructive loading can add significant complexity and expense to the machine and/or can negatively affect overall system speed and performance in other ways.

A desirable feature of clamp ring manufacturing machines is the ability to manufacture rings having different sizes. Although some existing machines can produce such rings, they do so by employing complex mechanisms that can be difficult to adjust and are expensive to manufacture and maintain. For example, when the desired radius of a spine wire is changed by changing the relative positions of upstream wire forming rollers, the feed path of the wire is usually also changed. Because the spine wire must still be fed between the dies as described above, some conventional clamp ring manufacturing machines employ elaborate adjustment and positioning mechanisms for re-positioning the spine wire through the dies. These mechanisms are often difficult to manipulate and consume valuable user time that could otherwise be used for making ring clamps.

Although the above discussion and the following description and claims is with reference to ring clamps, it should be noted that the present invention is relevant to the production of similar products that may or may not be in the form of a ring (and can be straight or take any other shape desired). The present invention lies not just in the ability to manufacture ring clamps, but more broadly in a machine and method for producing elements having a spine of any shape to which is connected one or more ribs of any shape used as clamps for holding any material to the spine. Therefore, the term "clamp ring" as used herein and in the appended claims is intended to encompass similar devices having other shapes—whether resembling a ring or not. The connection between the spine and ribs is typically a welded connection of metal wires, but can be a brazed, soldered, glued, melded, or other connection of elongated elements made from any resilient material (e.g., plastic, composites, and the like) having any cross-section (e.g., round, oval, flat or ribbon-like, rectangular, square, polygonal, and the like) and size performing similar functions to the spine and ribs described above. Any material can be held to the spine, the material selected depending upon the application intended for the manufactured elements. Most commonly, the application is in making wreaths as will be described hereinafter by way of illustration only, wherein the material includes branches and/or other foliage. However, any other material can be used as desired.

In light of the problems and limitations of the prior art described above, a need exists for a clamp ring manufacturing apparatus and method in which ring clamps can be quickly produced with reliable, consistent and strong clamp-to-spine connections, the clamp ring size can be easily and readily changed, and in which the clamp ring manufacturing apparatus is simple, relatively inexpensive to manufacture, assemble, and maintain, and is not susceptible to fatigue from extended operation and cyclical forces. Each preferred embodiment of the present invention achieves one or more of these results.

SUMMARY OF THE INVENTION

Preferred embodiments of the present invention employ a clamp ring apparatus having an upper die assembly with an upper die, a lower die assembly with a lower die, an actuator for bringing the upper die assembly and the lower die assembly together (and more preferably for moving the upper die assembly toward and away from a stationary lower die assembly), a leg deflection element for offsetting legs of clamps formed by the apparatus, and a spring for controlling welding pressure on the wires formed to make the clamp rings. Spine and rib wires are fed into the apparatus from respective wire supplies, and are preferably brought into overlapping relationship between the upper and lower die assemblies. Wire guides on either of the die assemblies can be used to guide the wires to a position between the upper and lower dies. In some preferred embodiments, electrodes are located at or near this position. In one highly preferred embodiment, a lower electrode is received within a lower male die and an upper electrode is located between elements defining an upper female die. Preferably, each electrode is releasably held within its respective die assembly by a single fastener, thereby enabling fast and convenient electrode removal and replacement.

In contrast to some conventional devices, a single actuator is preferably employed both to move the die assembly to which it is attached and to move the electrode associated with that die assembly into welding position (the electrode preferably being secured in place upon the die assembly). The spring is preferably used to help control the force exerted upon the crossed wires between the dies, and preferably provides a constant die-separating spring force over a range of die positions. Improved welding pressure control enabled by the use of the spring provides for a greater ability to employ one actuator to form clamps and to press the wires together (thereby reducing apparatus complexity and increasing apparatus reliability), and also results in stronger, more reliable, and more repeatable welds.

Where used, the leg deflection element is preferably mounted in one of the die assemblies adjacent to the dies. In one preferred embodiment, the leg deflection element is located adjacent to a male die on one of the die assemblies. The leg deflection element has a leg deflection surface against which the leg of a clamp being formed is pressed and passes, thereby offsetting the leg with respect to some or all of the rest of the clamp. Preferably, the leg leaves contact with the leg deflection surface before the clamp is fully formed. Therefore, undesirable forces which can be generated by leg deflection in the later stages of a clamp's formation are avoided. This helps to prolong the life of the actuator.

A wire guiding mechanism can be used to shape the spine wire to a desired radius of curvature, and preferably employs adjustable elements upon which wire forming rollers are mounted. Preferably, each adjustable element can be releasably secured in place by one or more releasable fasteners and in some highly preferred embodiments can be precisely adjusted to different positions by one or more positioning screws. The positions of the forming rollers with respect to the dies and with respect to each other can thereby be quickly and easily changed to change the shape of the spine wire.

Some preferred embodiments of the present invention also employ a cutoff lever assembly used to cut off the spine wire after a clamp ring has been completed. Preferably, the cutoff lever is pivotably mounted to one die assembly and is actuated by being pressed by a positionable block connected to the other die assembly. The block is preferably connected to and positionable by an actuator which, when actuated for cutting the spine wire, moves adjacent to the cutoff lever and is pressed against the cutoff lever when the movable die assembly is actuated to form the next clamp. In some embodiments, the weight of the die assembly assists in cutting the spine wire with the cutoff lever, thereby reducing the power requirements of the apparatus.

Preferably, various elements in the die assemblies are adjustably mounted to increase the flexibility of the apparatus. For example, the wire guides can be adjustably mounted to change the angular relationship of the wires being attached, the leg deflection element can be adjustably mounted to change the amount (if any) of clamp leg deflection, and the wire forming rollers and the wire shaping mechanism can be adjustably mounted to change the shape of the spine wire.

To better control die assembly movement, to protect the actuator against undesirable lateral and torque forces, and to enable both die assemblies to be removed and replaced without disturbing their positions relative to one another, die post and collar sets can be attached to the die assemblies. Specifically, die posts on one die assembly can be telescopingly received within collars on the opposite die assembly.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings wherein like reference numerals indicate like parts.

DETAILED DESCRIPTION OF THE PREFERRED EMBODIMENTS

Figure 1:
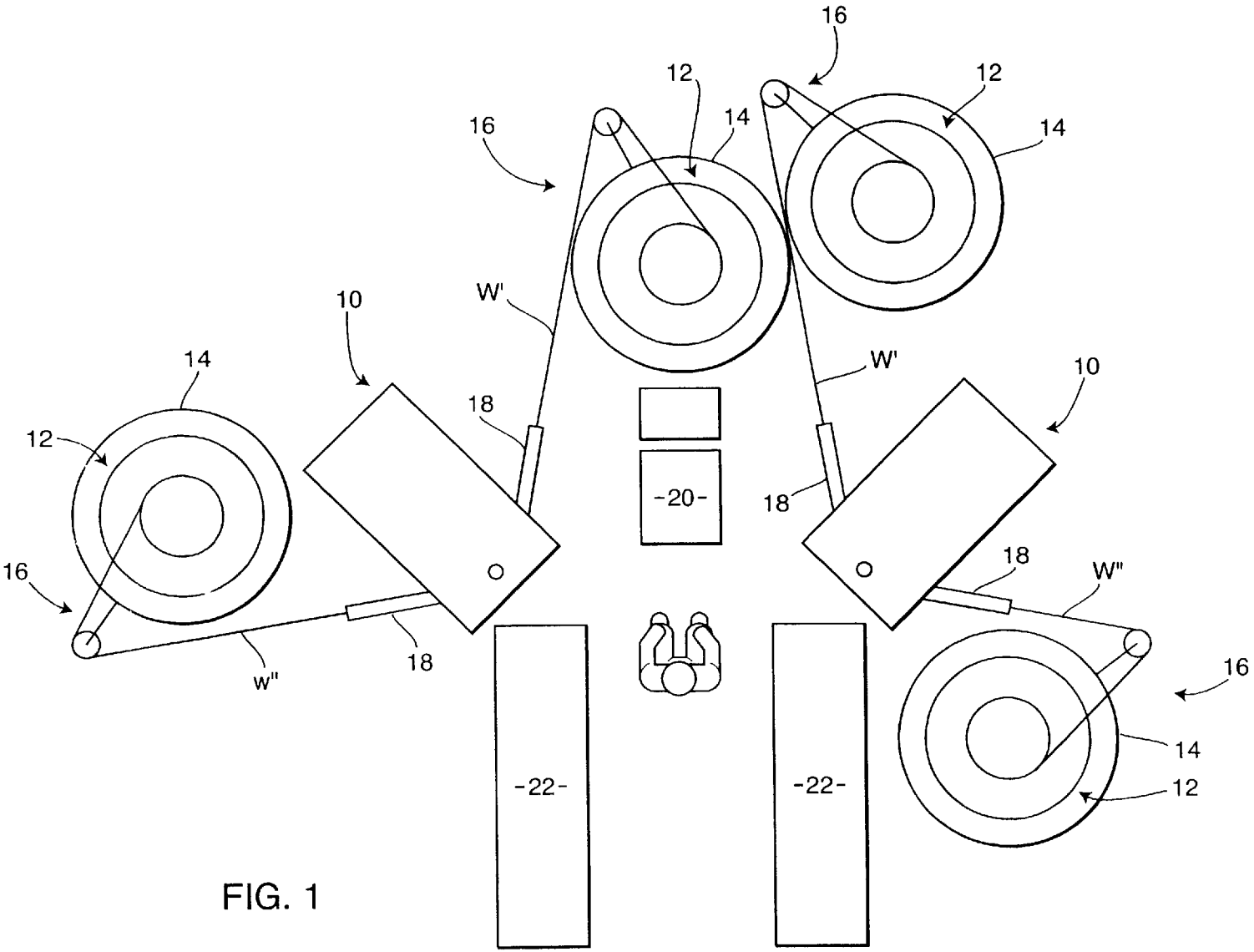
FIG. 1 is a schematic view of a clamp ring manufacturing system employing two clamp ring manufacturing apparatuses.
Figure 2:
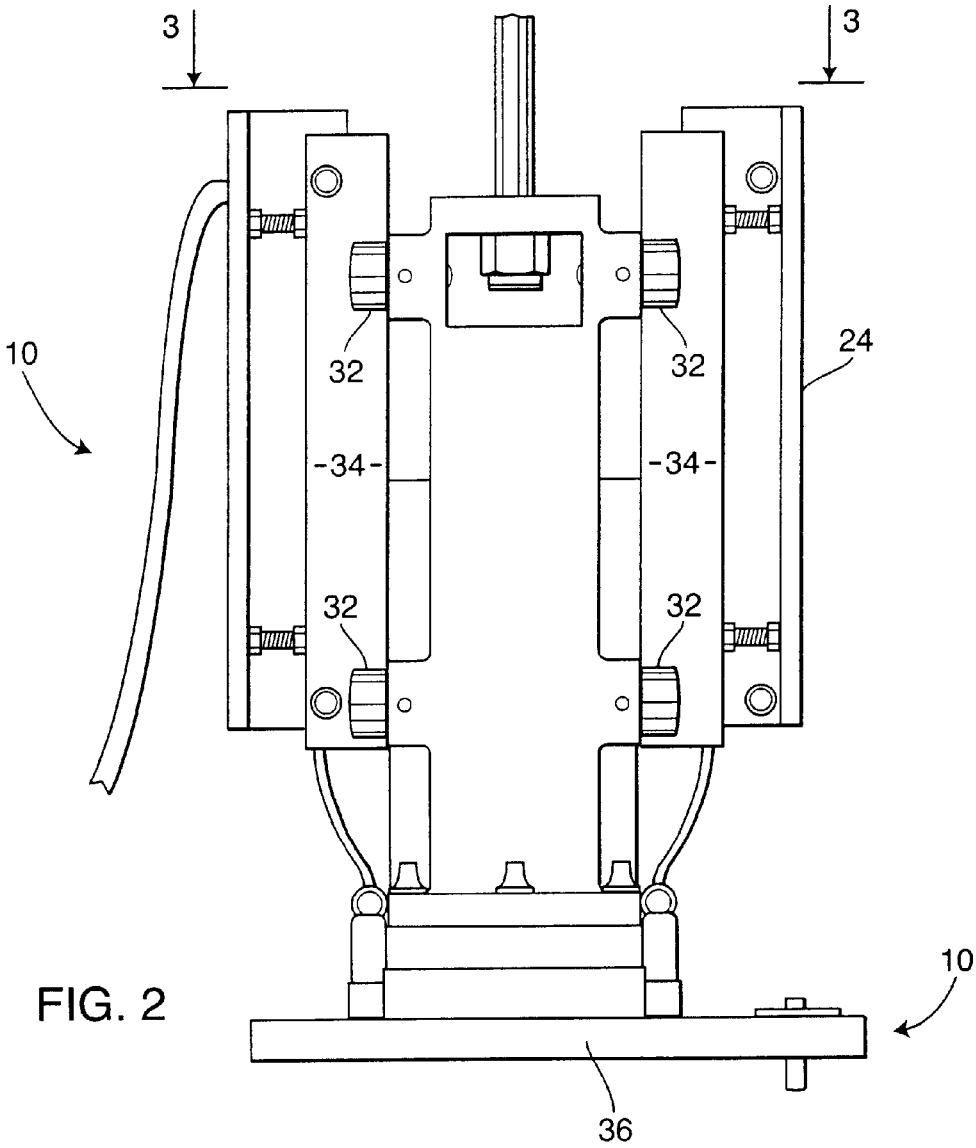
FIG. 2 is a front view of a top portion of the clamp ring manufacturing apparatus shown in FIG. 1, according to a first preferred embodiment of the present invention.
Figure 3:
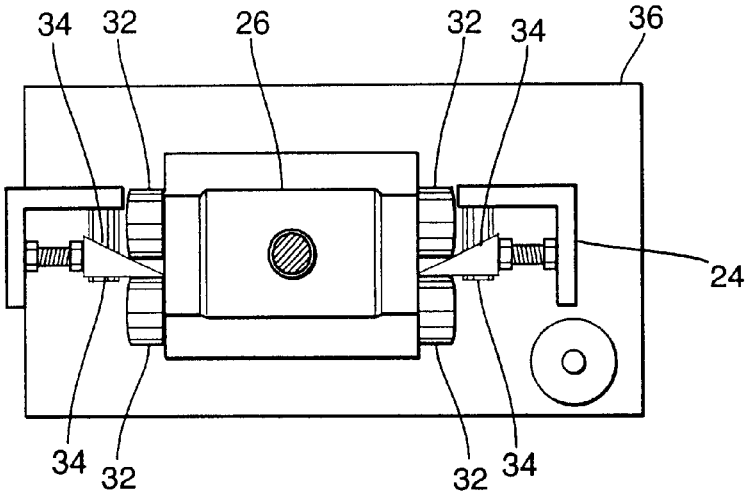
FIG. 3 is top view of the portion of the clamp ring manufacturing apparatus shown in FIG. 2.

An example of a system for manufacturing ring clamps in accordance with the present invention is illustrated in FIG. 1. Such a system preferably includes two clamp ring manufacturing assemblies, each of which includes a clamp attachment apparatus 10 according to the present invention to which are fed two wires W', W" from respective wire supplies 12. As described above, the wires W', W" can be of any material, size, or cross-sectional shape, but preferably are sufficiently strong and resilient to hold a desired form once bent or otherwise shaped thereto. The term "wire" as used herein and in the appended claim therefore is not limited to elements made of metal or having any particular cross sectional shape, size, number of strands, etc. For purposes of illustration and description only, the wires W', W" described hereinafter are single strands of steel having a generally round cross section. The wires can be identical in material, shape, or size, but more preferably are different for purposes that will be made clear below.

Preferably, the wire supplies are coils of wire wrapped about a wheel 14, stand, or other conventional wire winding device or element. More preferably, this wire winding device or element is capable of rotating to pay out wire to the associated clamp attachment apparatus 10 as needed. A conventional wire supplying mechanism 16 can be attached to the wheel 14 in a conventional manner for detecting when a sufficient amount of the wire W', W" has been drawn to thereby turn the wheel 14 a desired amount via a connected motor or other driving device (not shown). Wire payout devices, their manners of connection, and their operation are well known to those skilled in the art and are not therefore described further herein.

The wires W', W" are drawn from their respective wheels 14 by conventional wire drawing devices 18, which can be a series of rollers, pulleys, wheels, or other rotating elements through which the wires W', W" are pulled, reciprocating clamp mechanisms clamping and moving the wires W', W", and the like. Wire drawing devices, their manner of connection, and their operation are also well known to those skilled in the art and are not therefore described further herein.

Each clamp attachment apparatus 10 receives the wires W', W" fed thereto by the wire drawings devices 18, attaches the wires W', W" together as described in more detail below, and cuts the wires W', W" to form ring clamps (not shown). The ring clamps are then removed by an operator, and any final welding (such as welding the ends of a clamp ring together) is preferably performed by the operator using a welder 20. Slides 22 conveyors, buckets, or other material handling devices then transfer the completed ring clamps away from the system. Both clamp attachment apparatuses 10 can be operated at the same time in synchronicity, substantial synchronicity, or in any other timed or untimed relation with respect to one another. However, the clamp attachment apparatuses 10 are preferably timed to complete ring clamps in alternating succession at spaced-apart times to permit the system operator to complete final welding, ring clamp stacking, and/or other necessary operations following the completion of each ring clamp.

A more detailed view of one of the clamp ring apparatuses 10 is best shown in FIGS. 2–7C, it being understood that the two clamp ring attachment apparatuses 10 illustrated schematically in FIG. 1 are preferably substantially the same but are mirror images of one another. The clamp ring apparatus 10 preferably has frame 24 which can have multiple portions such as the upper portion illustrated in FIG. 2 and the lower portion illustrated in FIGS. 4–6. The clamp ring apparatus 10 also has an actuator 26 preferably mounted to an upper portion of the frame 24, an upper die assembly 28 connected to the actuator 26, and a lower die assembly 30 attached to a lower portion of the frame 24. The actuator 26 can take a number of different forms well known to those skilled in the art, including without limitation electromagnetic actuators, hydraulic actuators, screw actuators, and the like, but most preferably is a pneumatic actuator operably connected via air or gas lines in any conventional manner to move up and down. The actuator 26 preferably has rollers 32 rotatably attached thereto in any conventional manner and positioned on the actuator 26 to roll across roller surfaces 34 on the frame 24, thereby guiding the actuator 26 in its upward and downward movement. In some highly preferred embodiments such as that shown in FIG. 2, rollers 32 attached to the actuator 26 contact and roll upon multiple surfaces (e.g., front and rear surfaces 34 angled with respect to one another) in order to guide the actuator 26 in multiple degrees of freedom in the actuator's upward and downward movement.

The actuator 26 is preferably coupled to the upper die assembly 28 by releasable conventional threaded fasteners passed through matching apertures in the actuator 26 and the upper die assembly 28. In other embodiments, the actuator 26 can be connected to the upper die assembly 28 in any other conventional releasable or permanent manner, such as by welding, brazing, clamping, press fitting, and the like. Similarly, the lower die assembly 30 is preferably coupled to the frame 24 by releasable conventional threaded fasteners passed through matching apertures. In less preferred embodiments the upper and lower die assemblies 28, 30 are permanently mounted to the actuator 26 and frame 24, in any conventional manner.

With reference now to FIGS. 3–6, the die assemblies of the present invention will now be described in more detail. Each die assembly 28, 30 preferably has a die plate 36, 38, respectively to which are mounted dies 40, 42 for wire forming operations. Although other structure can be used in place of die plates 36, 38, such as a framework or a plurality of arms or stands for supporting the various elements of the die assemblies 28, 30, die plates are preferred.

As will be described in more detail below, various elements and structure are preferably mounted upon the die plates 36, 38 and perform various functions in the clamp ring manufacturing process. Regardless of the function performed by each such element, it is highly desirable to adjustably and/or releasably mount the elements to their respective die plates 36, 38. Most preferably, each such element is releasable from the die plate 36, 38 and has a position that is adjustable on the die plate 36, 38. In most highly preferred embodiments, the elements are releasably mounted upon the die plates 36, 38 by threaded fasteners passed through aligned apertures in the elements and die plates 36, 38.

For purposes of adjustability, more than one aperture or aperture set can exist for each point of connection, or (more preferably) slotted apertures can be employed to permit the elements to be fastened in multiple positions by the same fasteners and apertures. The preferred threaded fasteners can be bolts, screws, and the like having any head type capable of manipulation by a tool or even by hand. Also, the threaded fasteners can be removable from apertures in the die plates 36, 38 or can extend from the die plates 36, 38 to be passed through apertures in the elements and fastened by nuts or other such elements. The various elements attached to the die plates 36, 38 can instead be mounted by any other conventional fastening devices, including without limitation by clamps, dowel and pin connections, tongue and groove connections, and the like. Where adjustability or releasability is not desired, the elements can be attached to the die plates 36, 38 by welding, brazing, soldering, gluing, and the like, and can even be integral to the dies plates 36, 38.

Figure 4:
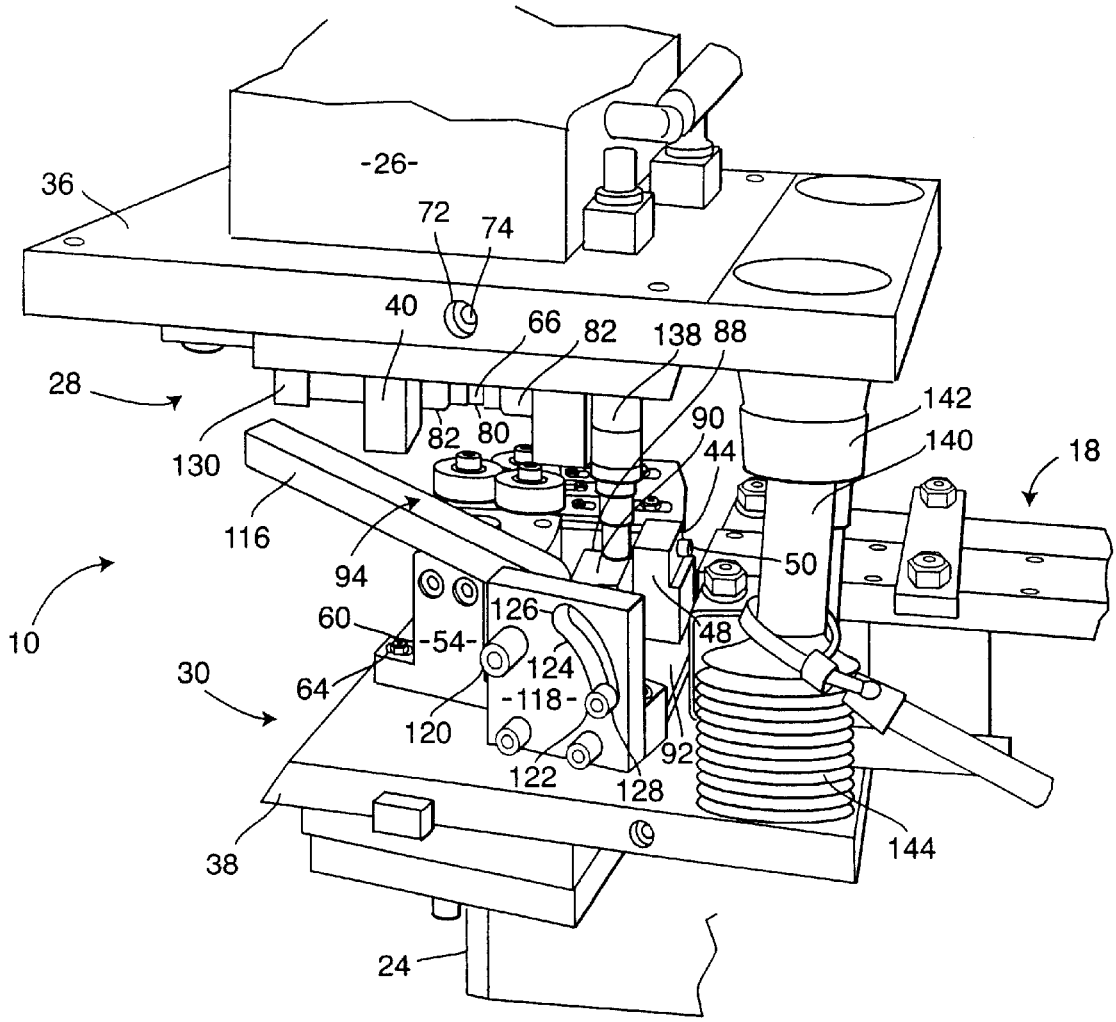
FIG. 4 is a perspective view of the clamp ring manufacturing apparatus illustrated in FIG. 1, shown with a die post boot partially removed.
Figure 5:
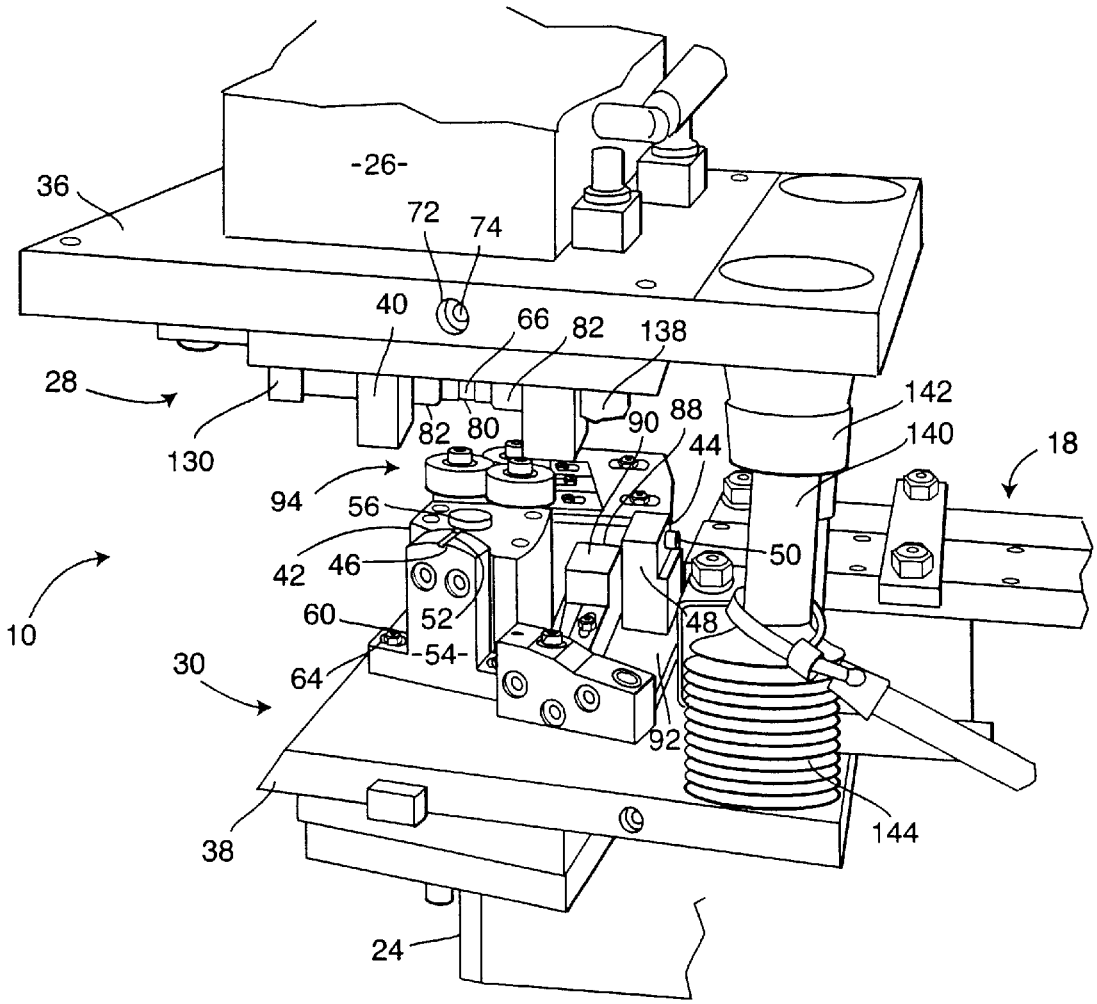
FIG. 5 is a perspective view of the clamp ring manufacturing apparatus illustrated in FIGS. 1 and 4, shown with the spine cutoff assembly removed for clarity.
Figure 6:
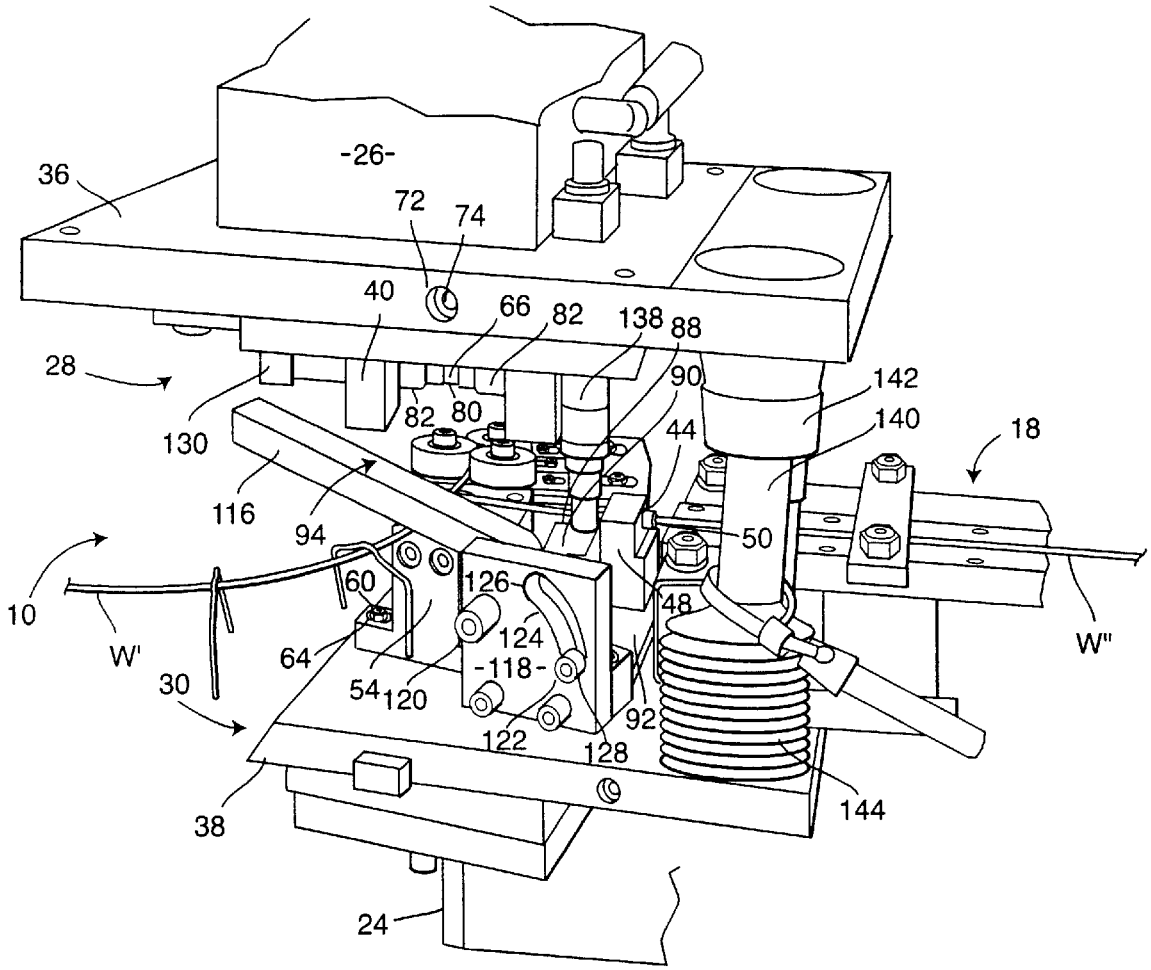
FIG. 6 is a perspective view of the clamp ring manufacturing apparatus illustrated in FIGS. 1 and 4, shown in the process of manufacturing a ring clamp.
Figure 7A:
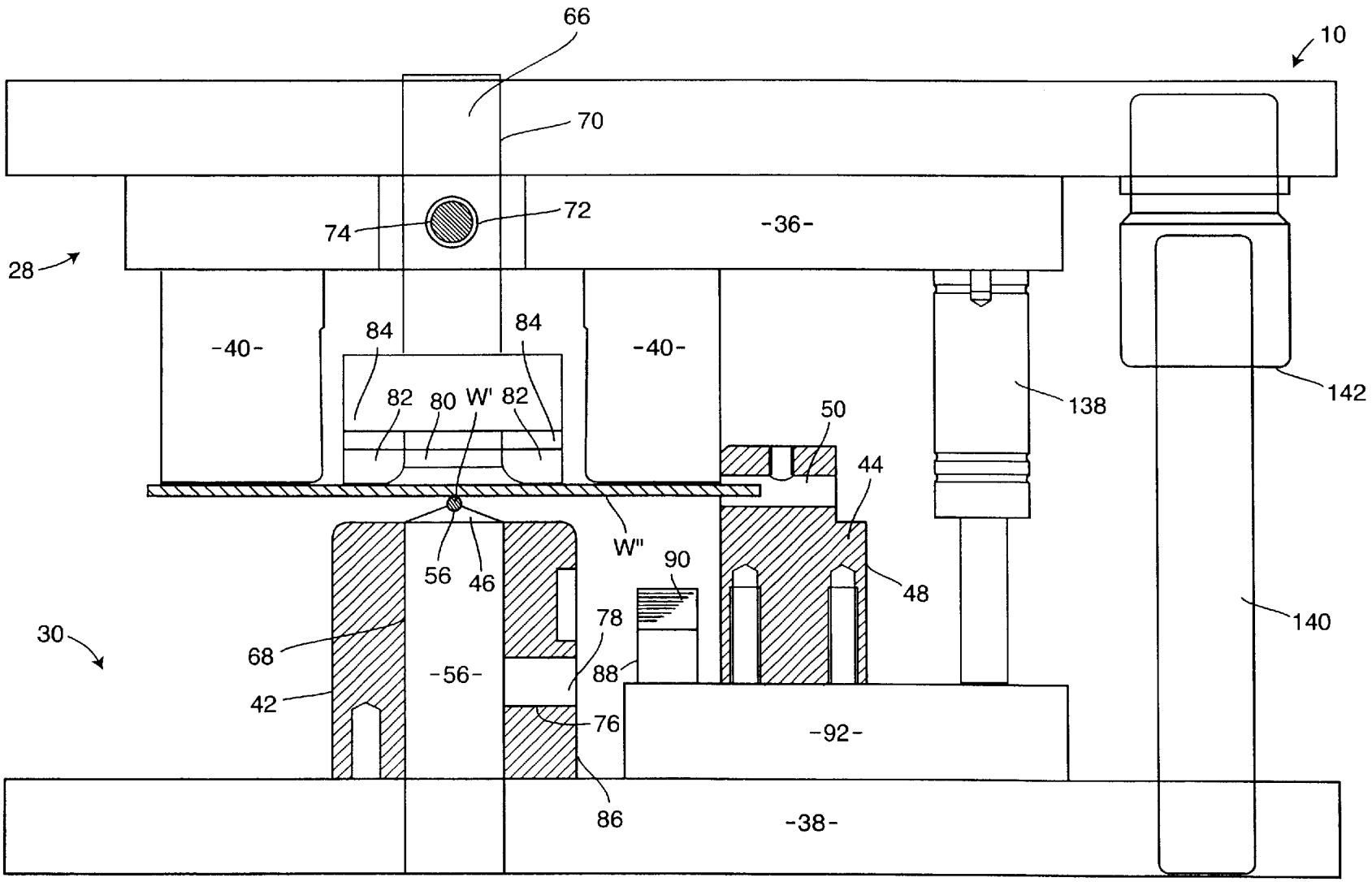
FIG. 7A is a cross-sectional front view of the clamp ring manufacturing apparatus illustrated in FIGS. 1 and 4–6, shown at the beginning of a clamp-forming cycle.
Figure 7B:
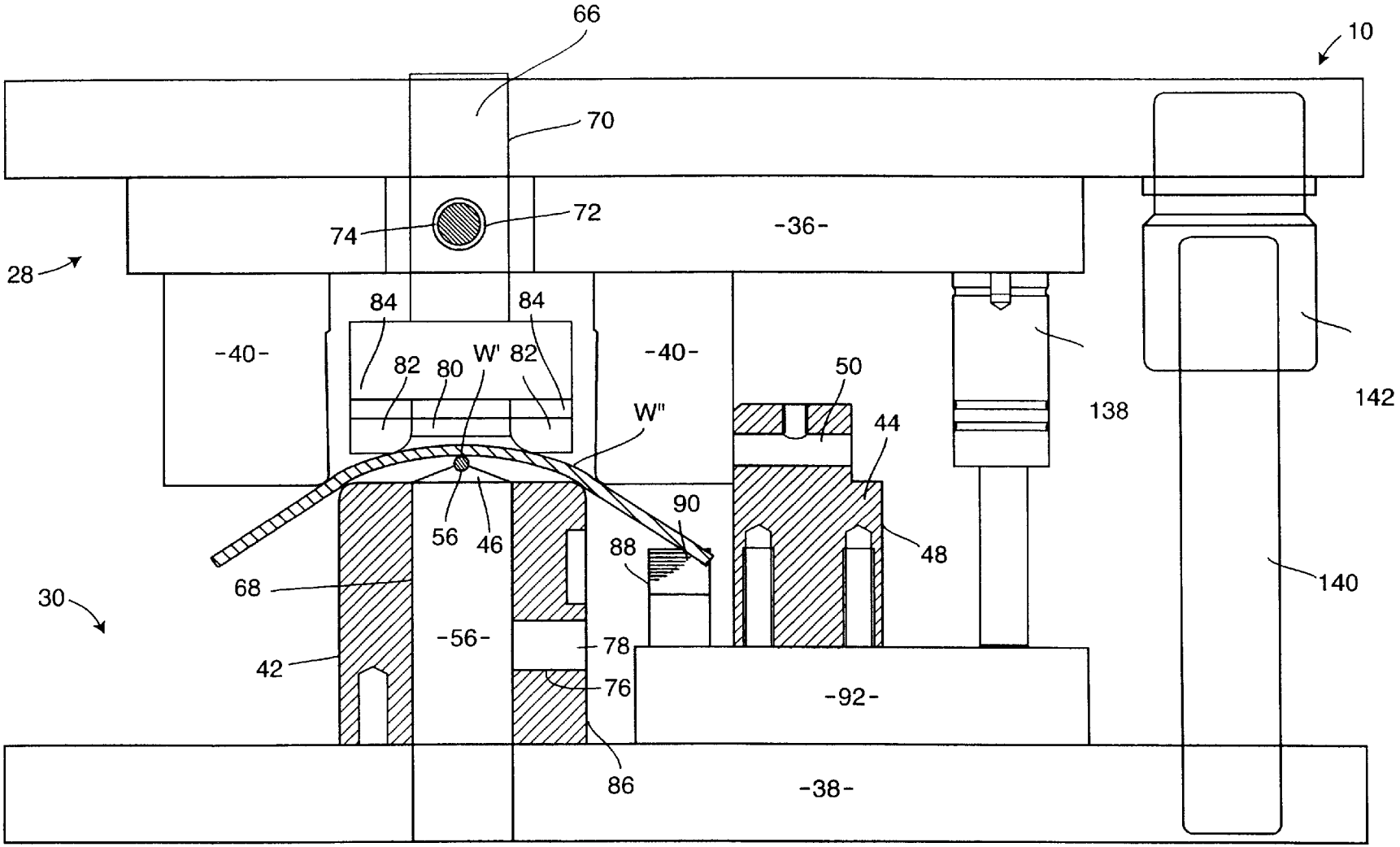
FIG. 7B is a cross-sectional front view of the clam ring manufacturing apparatus illustrated in FIGS. 1 and 4–6, shown during the clamp-forming cycle.
Figure 7C:
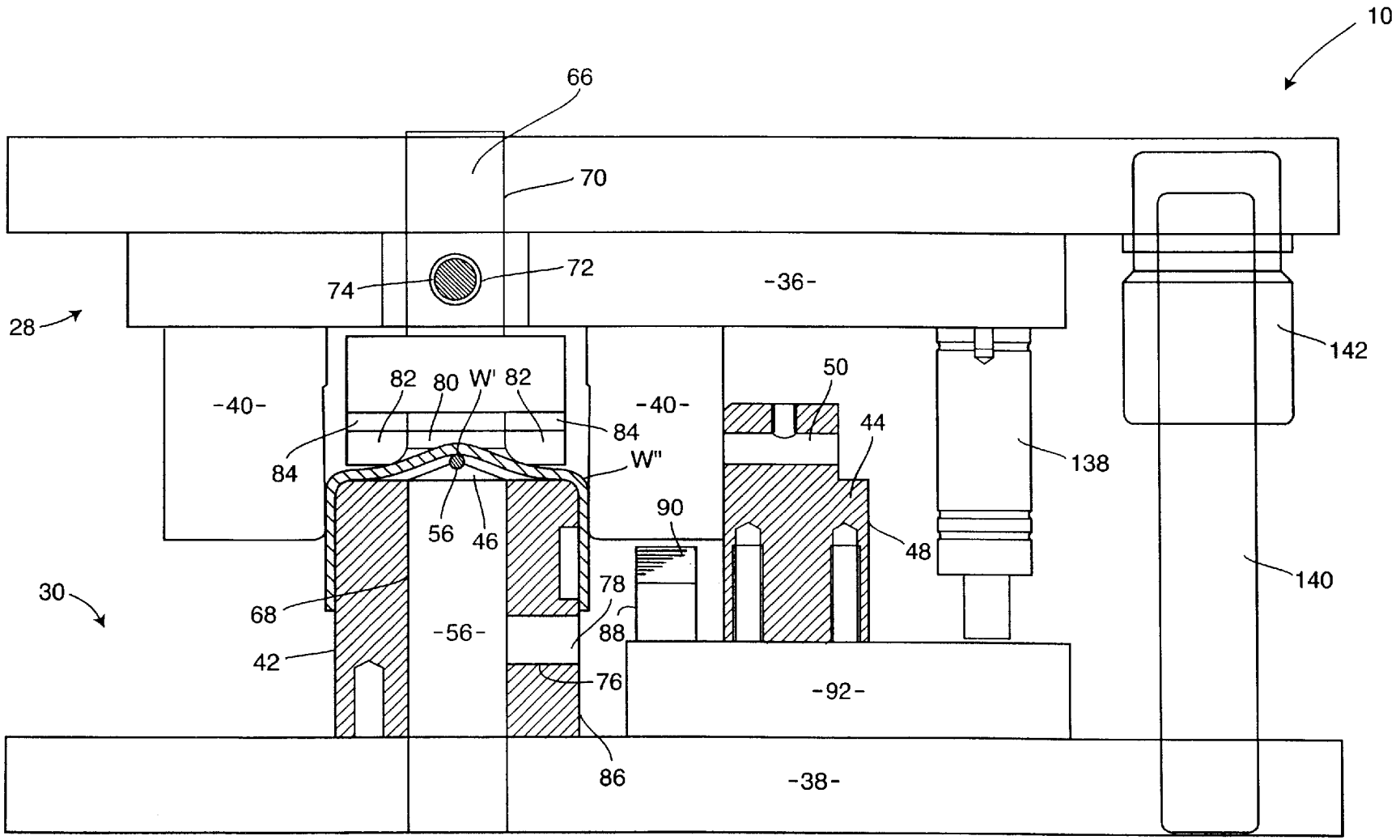
FIG. 7C is a cross-sectional front view of the clamp ring manufacturing apparatus illustrated in FIGS. 1 and 4–6, shown at the end of a clamp-forming cycle.

With continued reference to FIGS. 4–6, the wire drawing devices 18 are located adjacent to the die assemblies 28, 30 for feeding wires W', W" between the die assemblies 28, 30. One wire W' preferably acts as a spine for the ring clamps being manufactured and is therefore called the "spine wire", while the other wire W" is preferably used for making clamps to be attached to the spine wire, and is commonly referred to as a "rib wire". The preferred die assembly setup shown in the figures is for producing round ring clamps using wire W' as the spine wire and using thinner wire for the rib wire W" fed at an angle with respect to the spine wire W". However, it is possible to employ rib wire W" that is thicker or the same thickness as the spine wire W'. Also, by changing the positions and/or orientations of the various elements on the die assemblies 28, 30, it is possible to employ wire W' as the rib wire and wire W" as the spine wire with any desired relative sizes thereof.

The wire drawing devices 18 can be attached to the die assemblies 28, 30 or to the frame 24, or can instead be mounted upon a separate frame or otherwise be located a distance from the die assemblies 28, 30. For example, the wire drawing device 18 feeding the rib wire W" in the illustrated preferred embodiment is preferably attached to the lower die assembly 30 (preferably to the die plate 38 of the lower die assembly) by conventional threaded fasteners. Alternatively, this wire drawing device 18 can be welded, clamped, or permanently or releasably attached to the lower die assembly 30 in any other conventional manner. Also in the illustrated preferred embodiment, the spine wire drawing device 18 is preferably mounted to the frame 24 adjacent to the die assemblies 28, 30 in any conventional manner. Either or both wire drawing devices 18 can be mounted to a die plate or to machinery framework as desired. Although either or both wire drawing devices 18 can be attached to a movable die assembly such as upper die assembly 28, wire feeding is typically easier when the wire drawing devices 18 do not move with respect to the frame 24 of the clamp ring apparatus 10.

In some embodiments of the present invention it is possible to feed the wires to a desired location between the dies 40, 42 without guiding elements or surfaces. However, to better control the path taken by the wires W', W" between the die assemblies 28, 30, the clamp ring apparatus 10 preferably employs wire guides 44, 46 for the rib wire W" and spine wire W', respectively. The wire guide 44 for the rib wire W" is preferably a plate 48 having an aperture 50 through which the rib wire W" passes on its way to the dies 40, 42. The wire guides 46 for the spine wire W' are preferably notches, channels, or recesses 52 defined in a plate 54 (see FIGS. 7A–7C) adjacent to the dies 40, 42 and in an electrode 56 in the lower die 42.

Either wire guide 44, 46 can take a number of different forms performing the function of guiding the wires to a location between the dies 40, 42, including without limitation one or more apertures, grooves, notches, ribs, dimples, bumps, and the like. The wire guides 44, 46 can be located in plates attached to the lower die plate 38 as illustrated, or can be in any number of different elements, including without limitation in or on a post, arm, wall, block, finger, or other element. A single wire guide can be used for each wire W', W" (such as wire guide 44 for rib wire W", or if one of the wire guides 46 for the spine wire W' are dispensed with). However, more than one wire guide can be employed for better control over wire movement (such as wire guides 46 described above, or if a spine wire guide 46 is located on both sides of the lower die 42). The wire guides 44, 46 of the illustrated preferred embodiment are connected to the stationary lower die plate 38 due to the fact that the wire drawing devices 18 are stationary adjacent to the lower die assembly 28. In other embodiments of the present invention, wire guides can be located on a moving die plate instead, especially where the wire drawing devices are movable therewith. It may be desirable to adjust the path through which the spine and rib wires W', W" move. Accordingly, the plates 48, 54 (or other wire guiding elements employed) are preferably adjustably mounted to the lower die plate 38 in any manner described above. More preferably, the plates 48, 54 are adjustably mounted to the lower die plate 38 via releasable threaded fasteners 58, 60 passing through slotted apertures 62, 64 in the plates 48, 54. In some highly preferred embodiments such as the one shown in the figures, the wire guides 44, 46 are adjustable at least to different lateral positions with respect to the feed paths of the wires. Also preferably, the fasteners employed to mount the plates 48, 54 are releasable to permit removal and replacement of the wire guides 44, 46 as desired. This option permits the user to replace existing wire guides 44, 46 with different wire guides adapted to better guide different types of wire being run in the clamp ring apparatus 10.

The upper and lower dies 40, 42 of the present invention are employed to shape the rib wire W" into clamps for the clamp rings being produced. A number of different clamp shapes exist and are possible, each of which can be made by dies having varying structures. Most commonly, clamp ring clamps have a generally U-shape, with a back and two opposed legs between which the material to be held within the clamp ring is received. The legs are bent over and around the material to thereby hold the material to the spine of the clamp ring as is well known in the art. One having ordinary skill in the art will appreciate that other clamp ring shapes are just as effective at holding material in the clamp ring, such as U-shaped clamp rings with a curved (concave or convex), stepped, angled, or straight back, L-shaped clamp rings having one or two legs, W-shaped clamp rings, and the like. Dies capable of bending wire into such shapes are well known to those skilled in the art and are not described in greater detail herein apart from the preferred dies 40, 42 discussed below.

Preferably, the dies employed in the present invention are mating male and female dies, wherein the male die is shaped to fit within the female die to shape wire between the dies. However, it should be noted that other possible die structures do not necessarily have identifiable male and female counterparts, but nevertheless still have two or more dies cooperating to shape the wire located therebetween. Such dies and die structures fall within the spirit and scope of the present invention.

With reference to FIGS. 3–6, the upper and lower dies 40, 42 are female and male dies, respectively, although this orientation can be reversed if desired. The lower die 42 preferably has a block form, while the upper die 40 is preferably defined by two blocks which flank the lower die 42 when the upper die 40 is mated with the lower die 42. Like the wire guide plates 46, 48, the dies 40, 42 can instead be defined by one or more fingers, plates, walls, arms, and the like arranged to present the same surfaces as those of the preferred dies 40, 42 about which the rib wire W" is bent. Accordingly, the dies 40, 42 can be different in shape and form while still having the same or similar wire bending surfaces as the preferred illustrated dies 40, 42. For example, although the upper die 40 is preferably defined by two blocks, the upper die 40 can be a single element having legs or similar portions that extend in a similar manner as the blocks shown in the figures.

By virtue of the preferred die shapes shown in FIGS. 3–6, rib wire W" fed between the dies 40, 42 in their open position is bent into a U-shape when the dies 40, 42 are brought together. As will be described in more detail, further wire shaping is possible (and preferred) by adding other die components to the blocks described above.

The upper and lower dies 40, 42 can be mounted to their respective die plates 36, 38 in any manner described above, but are preferably releasably mounted via threaded fasteners. In alternative embodiments, the positions of the upper and lower dies 40, 42 on the die plates 36, 38 can be adjusted as desired as also described above.

In order to attach the rib wire W" to the spine wire W', each die assembly 28, 30 preferably includes an electrode 66, 56, although more than one electrode per die assembly is possible. The electrodes 66, 56 are brought into contact with the crossed wires W', W" so that electricity can be passed therethrough to weld the wires W', W" together at their point of contact. Because the weld is generated by melting the wire material together (under intense heat generated by the electricity passed therethrough via the electrodes), this welding preferably does not require welding flux, wires, gas, or other material to complete the weld. In the preferred illustrated embodiment, the lower electrode 56 is stationary, is located within an electrode receptacle 68 within the lower die 42, and is also insulated therefrom in any conventional manner, such as by a cylindrical liner or layer between the lower electrode 56 and the lower die 42. The lower electrode 56 can be electrically connected to an electrical welding circuit in any conventional manner, such as by an electrical contact or an electrical connection at the bottom of the lower electrode 56 though an aperture in the lower die plate 38 (not shown).

Also in the preferred illustrated embodiment, the upper electrode 66 is preferably received within an aperture 70 in the upper die plate 36 for movement therewith via the actuator 26 connected to the upper die plate 36, and is also insulated from the upper die plate 36 in any conventional manner, such as those described above with reference to the lower electrode 56. Depending upon the location and manner of connection of the electrodes 56, 66 in the die assemblies 30, 28, it is possible to employ electrodes 56, 66 that are not insulated, but are only spaced from electrically conductive elements and structure in the die assemblies 28, 30. Like the lower electrode 56, the upper electrode 66 can be electrically connected to the welding circuit in any conventional manner, such as by an electrical connection at the top of the upper electrode 66 in or above the aperture 70 of the upper die plate 36.

In highly preferred embodiments such as the one shown in the figures, the electrodes 56, 66 are preferably releasable and removable from the die assemblies 30, 28 to permit electrode maintenance and changeout as needed. Unlike conventional clamp ring manufacturing machines, in which multiple fasteners that are difficult to access and release are employed to secure welding electrodes, the electrodes 56, 66 of the present invention can preferably be released by manipulation of a single fastener accessible without moving or disassembling any part of the clamp ring apparatus 10. Specifically, a partially or fully-threaded aperture 72 preferably extends in the upper die plate 36 to the aperture 70 within which the upper electrode 66 is received. A setscrew 74, bolt, or other threaded fastener is preferably threaded within the aperture 72 and can be tightened to press against or otherwise hold the upper electrode 66 in its place in the aperture 70. When tightened, the threaded fastener 74 can press against a flat or be received within an aperture or recess of the upper electrode 66 or of an insulator surrounding the upper electrode 66, but more preferably presses against the outer cylindrical wall of a cylindrical insulation layer (not shown) surrounding the upper electrode 66. Unobstructed access to the threaded fastener 74 is preferably from a side of the die assembly 28 through the aperture 72, whereby loosening the threaded fastener 74 alone permits removal of the upper electrode 66 from the upper die assembly 28.

As an alternative to a threaded fastener being received within a threaded aperture, the upper electrode 66 can be held in place in the upper die assembly 28 by a retractable pin, key, post, rod, and the like extended through an aperture in the upper die plate 36 to press against a surface of or otherwise extend within an aperture or recess in the upper electrode 66 or its insulator. By retracting the pin, key, post, rod, threaded fastener, or other element from the upper electrode 66 the upper electrode 66 is preferably free to fall from or be pulled from the upper die aperture 70.

Although the threaded aperture 72 is preferably located in the upper die plate 36, such an aperture can be in other locations with respect to the upper electrode 66 while still enabling the threaded fastener 74 to be manipulated to hold the upper electrode 66 in place in the upper die plate aperture 70. For example, a threaded aperture can be located in a boss or arm extending from the upper die plate 36, in a portion of the upper die 40, or in any other upper die assembly structure adjacent to the upper electrode 66. In this regard, it should be noted that the upper electrode 66 need not be located in an aperture 70 in the upper die plate 36 (although this is preferred), but can instead be located within one or more raised walls or blocks on the upper die plate 36, a lip extending from the upper die plate 36 about the upper electrode 66, one or more elements attached to the upper die plate 36 adjacent to the upper electrode 66, in an aperture within the upper die 40 (for upper die shapes different than that of the illustrated preferred embodiment), and the like.

The lower die 42 preferably also has a partially or fully threaded aperture 76 through which a threaded fastener 78 is passed to hold the lower electrode 56 in the lower die assembly 30. Alternatives to a threaded aperture and fastener arrangement are also possible as described above with reference to the upper electrode 66. Like the upper electrode 66, the lower electrode 56 can preferably be removed following release of the single fastener via the aperture 76.

The lower electrode 56 need not necessarily be located in the lower die 42 as is shown in FIGS. 5, 7A, 7B, 7C, and 8, and can instead be located beside the lower die 42 or even a distance from the lower die 42 in less preferred embodiments. In such cases, the wires W', W" are still in electrical contact with both electrodes 56, 66 during welding operations thereof, and are clamped between surfaces of the dies 40, 42 to establish the necessary pressure for welding. In the illustrated preferred embodiment, the intersection of the wires W', W" is compressed between the electrodes 56, 66 to establish this pressure.

In some highly preferred embodiments of the present invention, one or more elements can be connected to either or both electrodes to assist in wire holding and/or wire forming. In the illustrated preferred embodiment for example, the upper die 40 includes die elements 80, 82 attached to the upper electrode 66 in any conventional manner. Specifically, a central die element 80 has a concave surface imparting a raised back area to the rib wire W" when the rib wire is compressed between the upper and lower dies 40, 42. Flanking the central die element 80 are preferably two side die elements 82 shaped to impart a slight concave form to the rib wire W" on either side of the spine wire W". The die elements 80, 82 are preferably releasably attached to the upper electrode 66 by threaded fasteners passed through apertures in the die elements 80, 82 and threaded apertures in a face of the upper electrode 66. However, other fasteners and manners of permanently or releasably attaching the die elements 80, 82 to the upper electrode 66 are possible, including without limitation welding, riveting, pin and aperture sets, press-fitting, clamping, and the like. For additional die flexibility and adjustability (to change the shape of the wire(s) bent thereby), one or more shims 84 (see FIGS. 7A–7C) can be fastened with the die elements 80, 82 to the upper electrode 66 to change the location and/or relative positions of the die elements 80, 82 on the electrodes.

The die elements 80, 82 function to assist in forming one or both wires W', W" as desired, and may or may not be electrically conductive depending upon the desired path of electricity to the wires W', W" or whether electrical welding is performed to attach the wires W', W" together. Any number of die elements 80, 82 having any desired shape can be permanently or releasably mounted to one or both electrodes 56, 66 and in any arrangement to impart any desired shape to one or both wires W', W", to help in holding the wires W', W" during welding, and to assist in holding the wires W', W" while the remainder of the dies 40, 42 perform their wire-bending operations.

In some cases, it may be desirable to shape the upper and/or lower dies 40, 42 to permit easier removal of the wires W', W" (especially the rib wire W") therefrom after bending. For example, where round ring clamps are being manufactured, the wires W', W" are typically rotated away from the dies 40, 42 rather than being moved straight away from the dies 40, 42. Accordingly, the upper and/or lower dies 40, 42 preferably have external surfaces and corners that are curved, rounded, or otherwise shaped to reduce wire-to-die interference as the wires W', W" are moved with respect to the dies 40, 42. In the illustrated preferred embodiment for example, the lower die 42 preferably has at least one external surface 86 that is curved to reduce interference between the legs of a clamp after the rib wire W" has been bent over the lower die 42.

Especially where legs of clamps being formed in the clamp ring apparatus. 10 are opposite one another and are to be folded toward one another during clamping (such as when the dies 40, 42 form U-shaped clamps), some preferred embodiments of the clamp ring apparatus 10 preferably form the legs to be offset with respect to one another so that they do not interfere with one another when folded. Such embodiments accomplish this task without imparting undesirably high torque forces upon the actuator 26 by employing a leg deflection element 88 that is adjacent to the dies 40, 42 and that is not a surface against which the leg presses when the final stages of wire bending take place. Specifically, prior art machines employ elements that are part of or connected to a die and that have a surface against which the leg is pressed to the end of the wire forming process. This practice can impart significant torque loads well beyond the forces necessary to merely bend the leg out of alignment with the remainder of the clamp being formed.

The leg deflection element 88 is instead located adjacent to the dies 40, 42 and has a deflection surface 90 against which the leg presses and moves as the leg is bent. The deflection surface 90 is preferably angled with respect to horizontal and vertical and directs passing legs out of plane with the remainder of the clamp being formed. To reduce torque loads upon the actuator 26, a passing leg is swiped past the deflection surface 90 of the leg deflection element 88 and then preferably leaves contact with the leg deflection element 88 before clamp formation has been completed. In less preferred embodiments, the clamp leg can still be in contact with some part of the leg deflection element 88, but preferably without effect upon the leg's final form.

Any element having a surface capable of bending the leg of the rib wire W" can be employed. Therefore, the leg deflection element 88 can be a block, bar, finger, wall, or any other element desired. The leg deflection element 88 is preferably releasably mounted to the lower die plate 38 in any manner described above, and also preferably has an adjustable position on the lower die plate 38 as also described above. With reference to the illustrated preferred embodiment, this is accomplished by mounting the leg deflection element 88 on the same base 92 as the wire guide 44, although the leg deflection element 88 can be separately and adjustably mounted to the lower die plate 38 by releasable threaded fasteners. In addition to the preferred slotted aperture and releasable fastener arrangement described above, the leg deflection element 88 is also preferably adjustably mounted upon the base 92 by a slotted aperture and releasable fastener arrangement (although the wire guide 44 and leg deflection element 88 can instead be permanently secured to the base 92 or can even be integral with the base 92), thereby permitting the deflection element's position to be adjusted with respect to the wire guide 44. By adjusting the lateral position of the leg deflection surface 90 adjacent to the dies 40, 42, the amount of leg offset can be adjusted for the clamps being formed.

In other preferred embodiments of the present invention, the leg deflection element 88 can be mounted in different locations while still providing the leg deflection surface 90 described above. For example, a leg deflection element 88 can be located on an opposite side of the dies 40, 42 from that shown in the figures to deflect the other leg of each clamp being formed, or can be located on both sides of the dies 40, 42 to deflect both clamp legs.

Although the clamp ring manufacturing apparatus of the present invention can be adapted to manufacture clamp rings having one particular size (such as a clamp ring having a particular diameter based upon the amount of curvature of the spine wire W', a clamp ring having a particular number of clamps, or even a clamp device that is straight or is otherwise not in the shape of a ring), more preferred embodiments can be adjusted to vary the shape, size, and/or number of clamps on each device being made. The number of clamps on each device being made can be controlled by controlling the amount of spine wire W' that is fed through the dies 40, 42 between each rib wire forming and attaching operation (e.g., speeding the feed rate of spine wire W' between operations, changing the amount of time between operations, and the like). Such control is possible in a number of conventional manners well known to those skilled in the art, and is not therefore described further herein.

Clamp device shape and size are preferably controlled by a wire shaping mechanism 94 which can be attached to either upper or lower die assembly 28, 30, but which is preferably located on a stationary die assembly such as the lower die assembly 30 shown in the figures. The wire shaping mechanism 94 is preferably releasably mounted to the lower die assembly 30 and also is preferably adjustably mounted to the lower die assembly 30 in any manner described above. Preferably, the wire shaping mechanism 94 is mounted to the lower die plate 38 via releasably threaded fasteners 96 passed through slotted apertures 98 as also described above. The wire shaping mechanism 94 preferably has a base 100 upon which are mounted at least two wire shaping rollers 102 between which the spine wire W' is passed on its way to the dies 40, 42. As is well known to those skilled in the art, the positions of the rollers 102 with respect to the feed path of the spine wire W' and the positions of the rollers 102 with respect to one another at least partially determines the resulting shape of the spine wire W". The present invention provides a large degree of flexibility in the positions and relative positions of the rollers 102 as will now be described.

Figure 8:
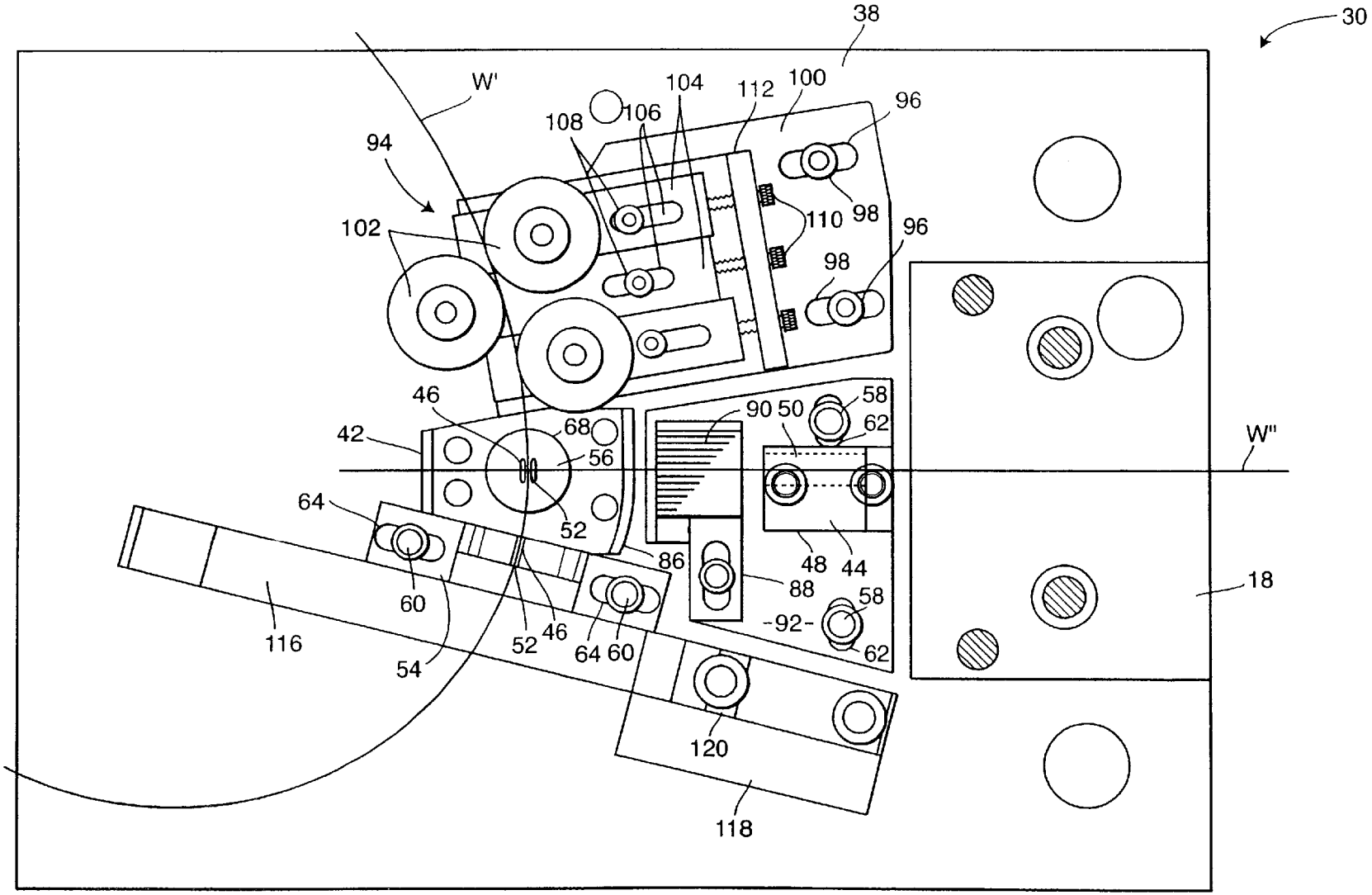
FIG. 8 is a top plan view of the lower die assembly illustrated in FIGS. 1 and 4–7C.
Figure 9:
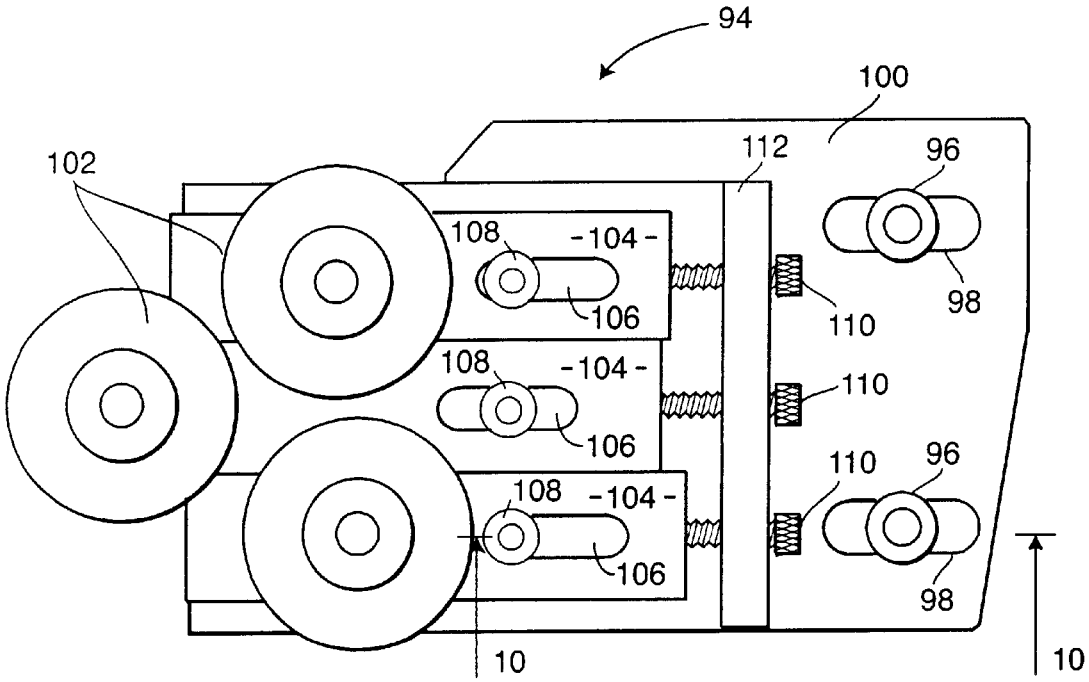
FIG. 9 is a top plan view of the wire shaping mechanism illustrated in FIGS. 4–6 and 8.
Figure 10:
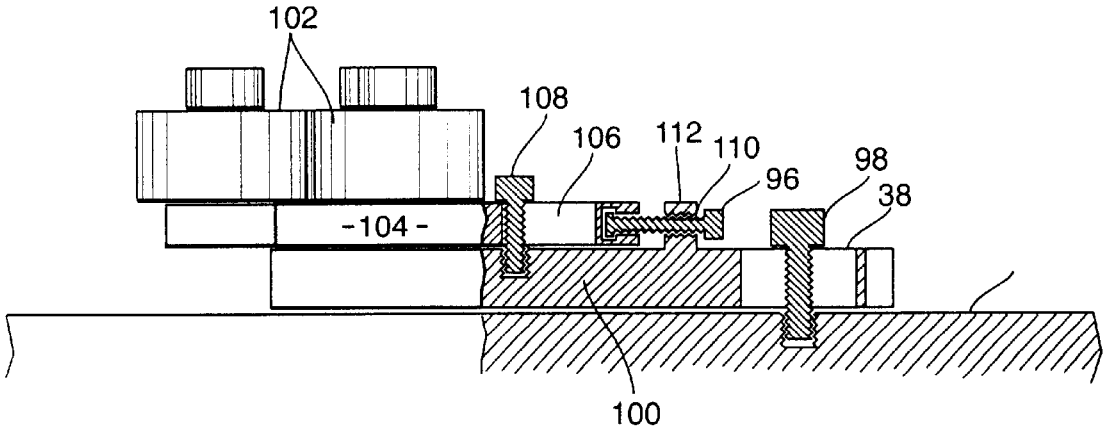
FIG. 10 is a cross-sectional view of the wire shaping mechanism illustrated in FIGS. 4–6, 8, and 9, taken along lines 10—10 of FIG. 9.

The wire shaping rollers 102 are conventional in nature and are not therefore described further herein. However, their manner of positioning and adjustment falls within the present invention. Specifically, each roller 102 is preferably mounted to the base 100 of the wire shaping mechanism 94 by adjustment elements 104. Specifically, each roller 102 is preferably mounted upon an adjustment element 104 that is movable into different positions upon the base 100. Most preferably, the adjustment elements are bars 104 as shown in FIGS. 8, 9, and 10, each of which has an elongated aperture 106 through which a releasable threaded fastener 108 passes into the base 100 for releasably tightening the bars 104 into different positions on the base 104. One having ordinary skill in the art will appreciate that the adjustment elements 104 can take a number of different forms, including without limitation rods, shafts or tubes telescoping within elongated apertures in the base 100 and securable into various positions therein by externally-accessible setscrews, clamps, pins, and the like, slidable plates fitted or dovetailed within grooves, tracks, or rails in the base 100 and securable therein by such fasteners, etc. In short, the adjustment elements can take any shape and form capable of having a roller 102 rotatably mounted thereto and capable of being moved and secured into different positions by one or more conventional releasable fasteners.

Although not required, improved control over each bar's position on the base 100 is preferably enabled by positioning screws 110 threaded within a positioning plate 112 on the base 100. The positioning plate 112 can be permanently or adjustably mounted to the base 100 in any manner described above, but is preferably mounted thereto by releasable threaded fasteners (not shown). The positioning plate 112 preferably has a threaded aperture 114 therein (see FIG. 10) for each adjustment element 104. A positioning screw 110 passes through each threaded aperture 114 and has an end rotatably fixed to the respective adjustment element 104 in any conventional manner (e.g., by a nut, washer, collar, or other element fixed on an end thereof and that is captured but rotatable within a cavity or aperture in the adjustment element 104). After loosening the fastener 108 holding an adjustment element 104 in place, the positioning screw 110 for that adjustment element 104 can be turned to precisely position the adjustment element 104 and roller 102 thereon. The fastener 108 can then be tightened to hold the adjustment element 104 and roller 102 in a desired position. Alternatively, the positioning screw 110 can press against a surface of an adjustment element 104 that is spring-biased against the positioning screw 110. Turning the positioning screw 110 in one direction therefore pushes the adjustment element 104 in one direction while turning the positioning screw 110 in an opposite direction permits the adjustment element 104 to return under pressure from the spring. One having ordinary skill in the art will appreciate that a number of other devices and manners exist for precisely positioning the adjustment elements 104 via the positioning screws 110, each one of which falls within the spirit and scope of the present invention.

The positioning plate 112 (if used) can take any shape or form desired, and need not necessarily be located between the base 100 and the adjustment elements 104 as shown in the figures. For example, the positioning plate 112 can instead be located on top of the adjustment elements 104 or can take the form of an enclosure enclosing the ends of the adjustment elements 104 opposite the rollers 102 and within which the adjustment elements 104 can slide, telescope, shift, or otherwise move to different positions with respect to the base 100 (whether by positioning screws 110 or not).

In the illustrated preferred embodiment, three rollers 102 are employed to shape the spine wire W' prior to being fed to the dies 40, 42. Each roller 102 is rotatably mounted upon a bar-shaped adjustment element 104 that is adjustably mounted upon the base 100 by a releasable fastener 108 and a positioning screw 110 as described above. The position of one or more rollers 102 can be independently adjusted to change the radius of curvature imparted to the spine wire W' by the rollers 102, or even to permit the spine wire W' to pass without imparting any curvature at all. For larger adjustments however, the position of the entire wire shaping mechanism 94 can be adjusted by loosening the base fasteners 96, repositioning the base 100 upon the lower die plate 38, and tightening the base fasteners 96. Particularly because adjusting the curvature imparted upon the spine wire W' is a fairly delicate procedure, this fine and rough positioning feature permits much faster adjustment while still maintaining a high degree of precision in such adjustment compared to existing devices and methods.

In order to separate a completed clamp ring from a new clamp ring being manufactured, the present invention preferably employs a cutoff lever 116 pivotably mounted about a pivot 120 on a cutoff lever mount 118. The cutoff lever mount 118 can be releasably mounted and/or adjustably mounted to the lower die plate 38 in any manner described above. The cutoff lever 116 is preferably a bar, rod, or other elongated element pivotable beside the wire guide 46. More preferably, the cutoff lever 116 is immediately beside the wire guide 46, enabling the cutoff lever to cut the spine wire W' against the wire guide 46 in a scissors-like action. The cutoff lever 116 can have any cross-sectional shape desired, but most preferably has a surface that presents a relatively sharp angle with respect to the face of the wire guide 46 toward which the spine wire W' is fed. Therefore, by lowering the cutoff lever 116, the spine wire W' is preferably cut between the top of the wire guide 46 (which preferably also has a relatively sharp-angled edge facing the cutoff lever 116) and the bottom of the cutoff lever 116. Relatively sharp adjacent edges of the cutoff lever 116 and the wire guide 46 are preferred for purposes of a clean and smooth wire cut. Alternatively or in addition, the wire guide 46 and/or the cutoff lever 116 can have a wire cutting blade or blades for cutting the spine wire W'.

To control the range of motion of the cutoff lever 116, the cutoff lever 116 can have a limit post or other projection extending therefrom and limited by one or more surfaces of the cutoff lever mount 118 or of any other preferably stationary element adjacent to the cutoff lever 116. By way of example only, the cutoff lever 116 in the illustrated preferred embodiment has a limit post 122 integral with or connected to the cutoff lever 116 and extending within an elongated aperture 124 in the cutoff lever mount 118. The upper and lower surfaces 126, 128 defining the ends of the aperture 124 limit the cutoff lever's motion. As another example, the end of the cutoff lever 116 opposite to the cutting end of the cutoff lever 116 can be located between upper and lower stationary jaws connected to the lower die plate 38, which jaws limit the pivot range of the cutoff lever 116. One having ordinary skill in the art will appreciate that a number of other elements and structure exist for limiting cutoff lever motion.

The cutoff lever 116 is preferably biased into its upper position. To this end, the pivot 120 can be spring-loaded in a conventional manner by a torque spring on the pivot 120 (not shown), the end of the cutoff lever 116 opposite to the cutting end of the cutoff lever 116 can have a large size and weight or have weights connected thereto in order to lift the cutting end of the cutoff lever 116, the limit post 122 can be biased into a lever-raising position by one or more springs in the elongated aperture 124, the end of the cutoff lever 116 opposite to the cutting end thereof can have a spring or other biasing element connected thereto and to the lower die plate 38, and the like.

Figure 11:
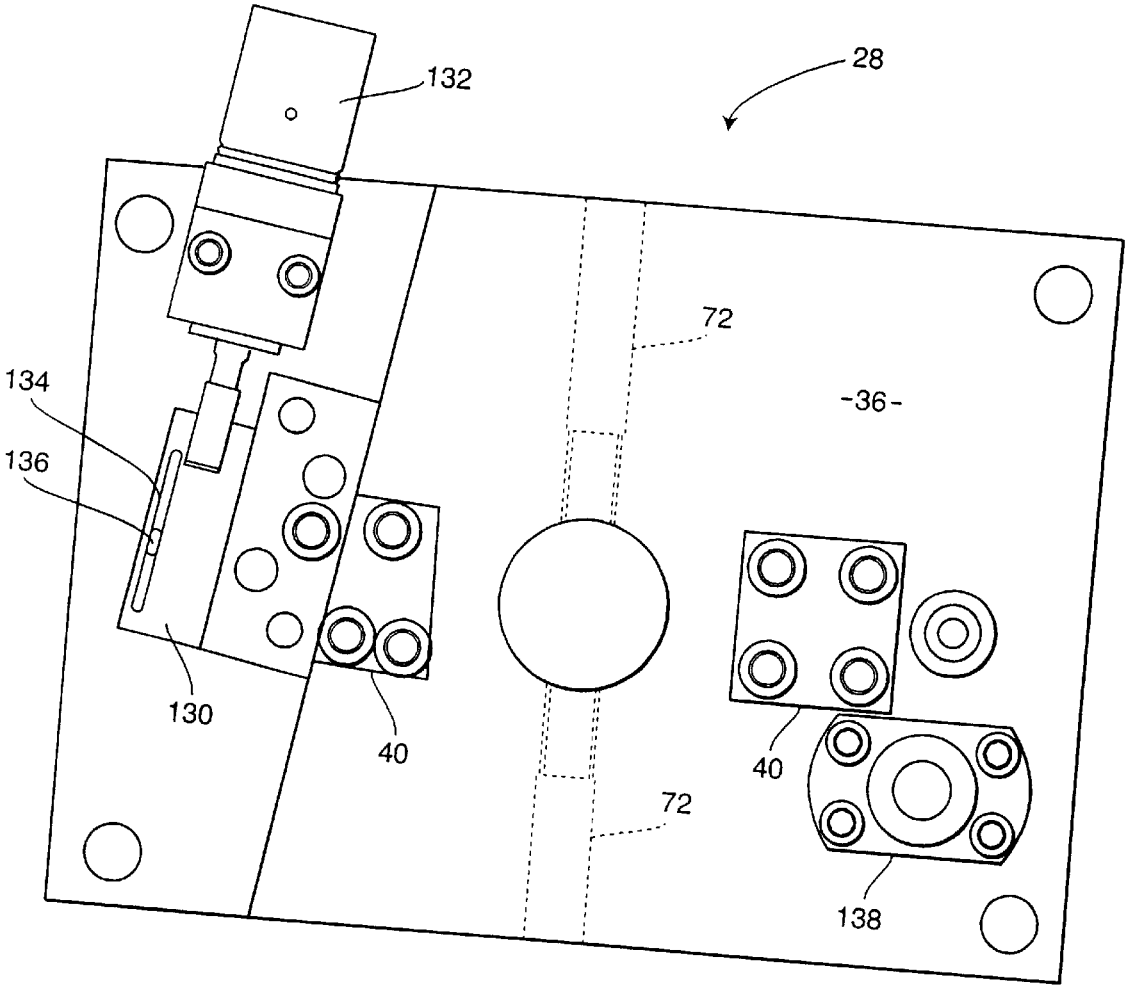
FIG. 11 is a bottom plan view of the upper die assembly illustrated in FIGS. 1 and 4–7C.

The cutoff lever 116 can be actuated in any number of conventional manners, including without limitation by a solenoid connected to the cutoff lever 116, a dedicated hydraulic or pneumatic actuator connected thereto, etc. However, the present invention preferably employs the force of the actuator 26 in conjunction with the weight of the upper die assembly 28 to perform this task, thereby lowering the energy needed for operation of the apparatus 10. Specifically, the present invention preferably employs a slide block 130 movable with respect to the cutoff lever 116 by a cutoff actuator 132 (see FIG. 11) connected thereto in a conventional manner. The cutoff actuator 132 is preferably a pneumatic actuator connected to and controlled by a system controller (not shown). The slide block 130 preferably has an elongated aperture 134 therein within which a post 136, pin, threaded fastener, or other element extending from the upper die plate 36 is received. The slide block 130 can therefore be moved to different positions on the upper die plate 36 by the cutoff actuator 132, and is preferably guided by the post 136 in the block aperture 134. Other manners of connecting the slide block 130 for such movement are possible, and include a dovetail sliding connection between the slide block 130 and the upper die plate 36, a track or rail along which the slide block 130 is movable (with or without the use of rollers, bearings, glides, and the like), etc.

When a cutoff command is received from the controller, from a user, or otherwise, the cutoff actuator 132 preferably moves the slide block 130 to a position adjacent to the cutoff lever 116. When the upper die assembly 28 is lowered, the slide block 130 pushes the cutoff lever 116 down, thereby cutting the spine wire W' between the cutoff lever 116 and the wire guide 46 as described above. After the upper die assembly 28 has been raised, the slide block 130 is returned to its original position removed from the cutoff lever 116, which is therefore inactive until the next cutoff.

In light of the function and purpose of the slide block 130 described above, the slide block 130 can take any form and shape capable of pushing the cutoff lever 116 sufficiently to cut the spine wire W'. Also, the cutoff actuator 132 can be replaced by other well known driving devices and assemblies, including without limitation an electric solenoid, a hydraulic actuator, a motor driving a pinion in a rack and pinion assembly attached to the slide block 130, and the like.

It will be appreciated by one having ordinary skill in the art that the cutoff lever, slide block, and cutoff actuator assembly can be replaced by a number of different wire cutting devices and assemblies. While each one of these devices and assemblies can be used and falls within the spirit and scope of the present invention, the cutoff lever, slide block, and cutoff actuator assembly is most preferred due to its advantageous use of apparatus weight, its simplicity, and the low power required for its operation.

As described in the Background of the Invention above, pressure is an important factor in the success and quality of welds generated by electric welding such as in the preferred embodiment of the present invention. Lack of control of the pressure on the wires W', W" during clamp attaching operations can result in weak clamp attachment or even in clamps that never become attached at all. To control weld pressure in the device of the present invention, a spring is employed to provide a known amount of force against the upper and lower die assemblies 28, 30 coming together (or in other words, a known amount of force separating the upper and lower die assemblies 28, 30). The amount of downward force exerted by the upper die assembly 28 can be determined, and is largely a function of the actuator strength and the weight of the upper die assembly 28. With this force being known, a desired force upon the crossed spine and rib wires W', W" can be exerted with relatively high precision through a range of upper die assembly positions by the use of a spring 138 having a constant spring rate through a corresponding range of compressions. Specifically, the desired force upon the crossed wires W', W" can be obtained by selecting a spring exerting a resistance to compression that is equal to the difference between the known force exerted by the upper die assembly 28 upon the crossed wires W', W" and the desired pressure upon the crossed wires W, W" (the desired welding pressure). By using such a spring, the welding pressure can not only be controlled, but can be controlled using a relatively strong actuator and through a range of actuator positions. In contrast to existing clamp ring manufacturing devices, this enables the apparatus of the present invention to employ only one actuator capable of both wire forming and welding operations, and results in a clamp ring manufacturing apparatus that provides much more accurate and repeatable welding pressures, and therefore more reliable welds and ring clamps.

For the above purposes, the present invention preferably employs a gas spring 138 having a relatively constant spring rate through a range of compressions. Such gas springs are conventional in nature and are not therefore described further herein. The gas spring 138 can be mounted to either die assembly 28, 30, and more preferably to either die plate 36, 38 in any manner described above. Also, the gas spring 138 can be releasably attached to either die assembly and/or have an adjustable position on either die plate 36, 38 as also described above. Most preferably, the gas spring 138 is mounted by conventional threaded fasteners to the upper die plate 36.

When the upper die assembly 28 is lowered in a clamp forming and welding operation, the free end of the gas spring 138 preferably contacts a surface of the lower die assembly 30 (preferably a surface of the lower die plate 38 or the frame 24). Continued lowering of the upper die assembly 28 compresses the gas spring 138 through a range of compressions in which the gas spring 138 exerts a relatively constant reaction force as described above until the crossed wires W', W" are fully compressed at the desired welding pressure, at which point electricity is passed through the electrodes and the wires W', W" are welded together.

If desired, the gas spring 138 can be replaced by another gas spring having a different spring rate to change the welding pressure on the wires W', W". In other preferred embodiments, springs having adjustable spring rates can be employed. Alternatively or in addition, the mounting height of the gas spring 138 on the upper die plate 36 can be adjusted in any conventional manner, such as by shims, by mounting plates having different heights, by threading a base of the spring into and out of a threaded aperture in the upper die plate 36, and the like. Such adjustability alters the resistance to compression force provided by some springs.

It should be noted that although the spring 138 is preferably a gas spring, other spring types can be used instead, such a compression coil spring or a leaf spring. In addition, the spring 138 need not necessarily be located between the die assemblies 28, 30, and can instead be attached to any part of the upper die assembly 28 above, below, or beside the upper die assembly 28 to generate the above-described spring force. Accordingly, many other types of biasing elements (each referred to herein and in the appended claims as a "spring") can be used, such as extension helical and gas springs. As an alternative to a single spring 138, more than one spring can be used as desired, and can connected to the upper die assembly 28 in different locations to provide the resistance force described above.

As mentioned above, torque control is highly desirable to reduce wear upon the actuator 26. In addition, control of torque can produce superior wire forming and cutoff results. To this end, the upper and lower die assemblies 28, 30 are preferably provided with die post and collar sets 140, 142. Each die post and collar set has a die post 140 received within a collar 142 and axially movable with respect to the collar 142 in relative movement of the upper and lower die assemblies 28, 30. With reference to the illustrated preferred embodiment in which a lubrication boot 144 is shown pulled down to expose the die post 140 and collar 142, the die posts 140 are preferably mounted to the upper die assembly 28 while the collars 142 are mounted to the lower die assembly 30 (although the reverse is possible in alternative embodiments). The die posts 140 and the collars 142 can be coupled to the upper and lower die plates 36, 38 in any conventional manner, such as by one or more fasteners, by having threaded ends received within threaded apertures in the die plates 36, 38, by being press-fit into apertures in the die plates 36, 38, by being welded to the die plates 36, 38, and the like. The die posts 140 can be solid or hollow, and can take any cross section desired, but preferably are tubes having round cross sections. One having ordinary skill in the art will appreciate that other conventional elements and devices can perform the same die assembly guiding and control functions as the die post and collar sets 140, 142, including without limitation rods on one die plate 36, 38 extending through apertures on the other die plate 38, 36, track or rail assemblies connected to the die plates 36, 38, and the like.

In the illustrated preferred embodiment, the die posts 140 in the die post and collar sets preferably move within the collars 142 as the upper die assembly 28 is raised and lowered with respect to the lower die assembly 30. In this manner, the upper die assembly 28 is guided as it is raised and lowered, thereby insuring a proper positional relationship of the various elements of the upper die assembly 28 with respect to the various elements of the lower die assembly 30 in each cycle of the apparatus 10. By maintaining this relationship using the die post and collar sets 140, 142, wire forming, cutting, and attachment operations are reliably performed.

The die post and collar sets 140, 142 also preferably perform another valuable function related to the setup of the present invention. Specifically, the die post and collar sets 140, 142 maintain the above-described positional relationship between the upper and lower die assemblies 28, 30 when these assemblies are removed from and installed within the clamp attachment apparatus 10. When the user desires to remove the assemblies 140, 142 (such as to replace the assemblies 140, 142 with another set of assemblies already set up for preparing clamp rings having other dimensions, to repair or maintain any portion of the apparatus 10, to adjust any of the elements on either or both die assemblies 28, 30, etc.) the user preferably lowers the upper die assembly 28 upon the lower die assembly 30 and releases the threaded fasteners connecting the die assemblies 28, 30 to the actuator 26 and frame 24, respectively. Both die assemblies 28, 30 can then be removed from and replaced within the apparatus 10 without disturbing the proper positional relationship between the die assemblies 28, 30 maintained by the die post and collar sets 140, 142. Even after the die assemblies 28, 30 have been separated, the die post and collar sets 140, 142 help in assembly alignment when the die assemblies 28, 30 are eventually put together and installed again in the apparatus 10. The ability to quickly remove either or both die assemblies 28, 30, replace the die assemblies 28, 30 with die assemblies already set up with the same or different configuration, and to thereby quickly continue system operation saves valuable production time otherwise lost to maintenance and apparatus setup.

In operation, the die assemblies 28, 30 are preferably assembled with the dies 40, 42, cutoff lever 116, wire guides 44, 46, leg deflection element 88, wire shaping mechanism 94, and spring 138 in their desired positions (whether secured in such positions or adjusted and then secured in such positions), and preferably with the rollers 102 of the wire shaping mechanism 94 adjusted to their desired positions. If not already done, the die assemblies 28, 30 are installed into the clamp ring apparatus 10 as described above. Preferably, the user enters the ring size and/or the desired number of clamps to be attached to each ring into the controller (not shown) via a keyboard, buttons, or other user-manipulatable control elements (also not shown) on the clamp ring apparatus 10. With this information, the controller can control the amount of wire fed by each wire drawing device 18 for making clamp rings with different radii and with different numbers of clamps. Alternatively, this information can be pre-programmed for the controller and can be referenced by the user via one or more conventional buttons or other controls designated for different types of clamp rings. In such embodiments, the user can use the controls to select from one of several different pre-programmed types of clamp rings as desired. Controller operation, input, and user interfacing capable of producing different types of clamp rings are well known to those skilled in the art and are not therefore described further herein.

The spine and rib wires W', W" are fed to the claim ring apparatus 10 from the wire supplies 12 via the wire supplying mechanisms 16 and the wire drawing devices 18 under control of the controller. Specifically, the spine wire W' is preferably fed beneath the cutoff lever 116, past the wire guide 46, over the lower die 42 and lower electrode 56 and through the wire guide 46 thereof, and through the rollers 102 of the wire shaping mechanism 94. The rib wire W" is preferably fed past the wire guide 44 and leg deflection element 88 and over the lower die 42 and lower electrode 56. In some highly preferred embodiments, the wire guides 44 are positioned to bring the wires W', W" together in a non-orthogonal manner (at other than a right angle with respect to one another). Although the wires W', W" can be brought together orthogonally, non-orthogonal wires can help in the leg offsetting process described in more detail below.

After a desired amount of each wire W', W" has been fed (corresponding to the desired clamp size for the rib wire W" and the desired spacing between clamps for the spine wire W'), the upper die assembly 28 is preferably lowered upon the lower die assembly 30 by the actuator 26 controlled by the controller. By lowering the upper die assembly 28, the rib wire W" is cut off preferably between the upper die 40 and the rib wire guide 44, thereby defining a leg of the clamp being made. The other leg of the clamp being made is that part of the rib wire W" on the other side of the lower die 42. By further lowering the upper die assembly 28, these legs are bent into the an upside-down U-shaped form mentioned above (over the lower male die 42 in the illustrated preferred embodiment).

As the leg facing the wire guide 44 is bent, this leg eventually contacts the leg deflection surface 90 of the leg deflection element 88. Because this surface 90 is at an angle with respect to the travel path of the leg, the leg is forced to bend in a lateral direction while being bent vertically, thereby imparting an offset to the leg. Preferably, the leg eventually moves past the leg deflection surface 90 and leaves contact with the leg deflection element 88 prior to being completely bent by the dies 40, 42 into the final clamp shape. After being bent by the leg deflection element 88, the only remaining resistance the leg provides is to being bent in the U-shape described above. Therefore, undesirable torque forces upon the various elements of the clamp ring apparatus 10 are avoided.

The upper die assembly 28 eventually reaches a position where the spine and rib wires W', W" are pressed together by the upper and lower dies 40, 42 and are in electrical contact with the upper and lower electrodes 66, 56. Preferably, the spring 138 in at least part of this upper die assembly travel provides a substantially constant spring force against the upper die assembly 28 in order to provide a controlled desired pressure upon the crossed wires W', W". At this point or soon thereafter, the controller causes electricity to pass through the electrodes to weld the crossed wires W', W" together. The controller then operates the actuator 26 to raise in order to release the formed clamp. The wire drawing devices 18 then draw the next amounts of wire into the apparatus 10 to begin another clamp making cycle.

The above-described process is preferably repeated until the last clamp ring is connected to the spine wire W". At this or a later time, the controller preferably actuates the cutoff actuator 132 to move the slide block 130 to its cutting position as described above. As the upper die assembly 28 is lowered to form another clamp (which can be the last clamp on the clamp ring, but which is more preferably one of the first clamps on the next clamp ring being made), the slide block is lowered upon the cutoff lever 116, which preferably cuts off the spine wire W' between the cutoff lever 116 and the wire guide 46 as also described above. The completed clamp ring can then be removed from the clamp ring apparatus 10 and can be closed by being welded in the welder 20.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the clamp ring apparatus 10 in the illustrated preferred embodiment is vertically oriented with the actuator 26 on top. In alternative embodiments, the clamp ring apparatus can be horizontal or can be at any angle with respect to vertical and horizontal as desired, with the actuator 26 located in any relative position and orientation. Also, although the preferred clamp ring apparatus 10 has one actuator 26 to move the upper die assembly 28 toward and away from a stationary lower die assembly 30, both die assemblies 26, 28 can be movable by their own actuators if desired.

The illustrated preferred embodiment is described above with reference to manufacturing ring clamps. One having ordinary skill in the art will appreciate that by adjusting the positions and orientations of the wire guides 44, 46, the wire shaping mechanism 94, and the rollers 102 thereon, the spine wire W' and the resulting clamp product being made can take any number of different shapes and can even be straight.

A number of alternatives exist to connecting the spine and rib wires W', W" together by welding. For example, rather than employing electrodes 56, 66 to weld the wires W', W"

together, the clamp ring apparatus 10 can be provided with a conventional glue-supplying mechanism to glue the wires together, a conventional solder-supplying mechanism to solder the wires together, and the like. In still other alternative embodiments, the wires can be connected together by hot-melting, stamping, brazing, or in any other conventional manner.

It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, frictionally engaging, mating, etc.), elements which can act upon one another (e.g., via camming, pushing, or other interaction) and one element imparting motion directly or through one or more other elements to another element.

We claim:

1. A clamp ring manufacturing apparatus for coupling a rib wire to spine wire and for forming ribs from the rib wire, the clamp ring manufacturing apparatus comprising:

first and second die assemblies having:

first and second electrodes; and first and second dies spaced apart to receive the rib and spine wires;

an actuator coupled to the first die and first electrode, the first die and first electrode movable by the actuator between a first position in which the rib and spine wires are held between the first and second electrodes and a second position in which the rib and spine wires have clearance to move between the first and second electrodes; and a spring biasing the first die assembly away from the second die assembly, the spring having a selected separating force exerted upon the first and second die assemblies corresponding to a desired compression force exerted upon the rib and spine wires;

the first die at least partially defining a recess cooperating with the second die to bend the rib wire between the first and second dies in the first position of the rib wire.

2. The apparatus as claimed in claim 1, wherein the first and second electrodes are secured against movement with respect to the first and second dies, respectively.

3. The apparatus as claimed in claim 1, wherein the spring is a compression spring.

4. The apparatus as claimed in claim 1, wherein the spring is a gas sparing.

5. The apparatus as claimed in claim 1, wherein:

the spring is compressible through a range of sizes, and the spring has a substantially constant spring force in at least a portion of the range of sizes.

6. The apparatus as claimed in claim 1, wherein the selected separating force of the spring plus the desired compression force exerted upon the rib and spine wires is approximately equal to force exerted by the actuator upon the first die.

7. The apparatus as claimed in claim 1, further comprising an leg offset element coupled to one of the first and second die assemblies adjacent to one of the first and second die corresponding thereto, the leg offset element having a surface located in a path taken by the rib wire between the first and second positions of the first die.

8. The apparatus as claimed in claim 7, wherein:

the leg offset element has a position adjacent to one of the first and second dies; and the position of the leg offset element is adjustable.

9. The apparatus as claimed in claim 1, wherein the dies are mating male and female dies.

10. The apparatus as claimed in claim 1, wherein:

at least one of the dies has a surface upon which the rib wire is bent, and the surface is curved to permit rotation of the rib wire off of the dies after being bent.

11. The apparatus as claimed in claim 1, further comprising at least one die post and collar assembly coupled between the first and second die assemblies, each die post and collar assembly having a collar and a die post movable within the collar to resist torque forces upon the actuator.

12. The apparatus as claimed in claim 1, further comprising:

a die plate in each die assembly and upon which the dies are mounted; and at least one die post and collar assembly coupled to and between the die plates, each die post and collar assembly having a die post and a collar within which the die post is movably received, wherein the die assemblies are removable from the apparatus as a unit in which the first die assembly is releasably coupled to the second die assembly by the at least one die post and collar assembly.

13. The apparatus as claimed in claim 1, wherein at least one of the first and second electrodes is releasably secured to its respective die assembly by a single releasable fastener coupled thereto.

14. The apparatus as claimed in claim 1, further comprising:

at least two ring form rollers through which the spine wire passes in a feed path to the first and second dies to impart a curve to the spine wire; and a ring form roller base coupled to the ring form rollers, wherein at least one of the ring form rollers is securable in more than one position with respect to another ring form roller to change the curve of the spine wire; and the ring form roller base is securable in more than one position with respect to the first and second dies to change the feed path of the spine wire.

15. The apparatus as claimed in claim 1, further comprising:

a cutoff block coupled to one of the first and second die assemblies; and a cutoff lever coupled to another of the first and second die assemblies; wherein the cutoff block is movable between a first position in which the cutoff lever is movable by the cutoff block to cut the spine wire and a second position in which the cutoff lever is not movable by the cutoff block to cut the spine wire.

16. A method of manufacturing a clamp ring, comprising:

feeding a spine wire between first and second dies;

feeding a rib wire between the first and second dies;

actuating an actuator coupled to the first die to move the first die toward the second die;

bending the rib wire between the first and second dies;

holding the spine wire in contact with the rib wire between two electrodes;

generating a biasing force upon the first die and away from the second die via a spring having a selected spring rate and force; and increasing compression of the spine and rib wires by the actuator until a desired compression force is reached determined at least partially by the biasing force exerted by the spring; and passing electrical current through the electrodes and through the spine and rib wires compressed to the desired compression force to weld the rib wire to the spine wire.

17. The method as claimed in claim 16, further comprising guiding the first die toward the second die by at least one die post and collar assembly, wherein each die post and collar assembly has a die post in telescoping engagement with a collar.

18. The method as claimed in claim 16, further comprising moving one of the electrodes into contact with at least one of the wires by moving the first die with the actuator.

19. The method as claimed in claim 16, wherein:

the spine and rib wires are compressed between the first and second dies; and the first die is moved and the spine and rib wires are compressed by the actuator.

20. The method as claimed in claim 16, wherein the actuator exerts a force that is approximately the same as the desired compression force plus the biasing force.

21. The method as claimed in claim 16, wherein the spine and rib wires are fed non-orthogonally with respect to one another.

22. The method as claimed in claim 16, further comprising:

entering into a controller a number of desired clamps to be attached to a ring;

repeating the feeding, actuating, bending, holding, generating, increasing, and passing steps until the number of desired clamps is attached to the ring; and cutting the spine wire after the number of desired clamps has been attached to the ring.

23. The method as claimed in claim 16, further comprising:

bending the spine wire with at least one ring form roller to provide the spine wire with a radius prior to feeding the spine wire between the first and second dies; and adjusting a position of a ring form roller to change the radius of the spine wire being fed between the first and second dies.

24. The method as claimed in claim 16, further comprising adjusting a position of a base upon which at least one ring form roller is mounted to change a path in which the spine wire is fed to the first and second dies.

25. The method as claimed in claim 16, wherein bending the rib wire includes:

bending a leg of the rib wire into contact with a deflecting surface adjacent to the first and second dies; and moving the leg across the deflecting surface to bend the leg out of a plane defined by a remainder of the rib wire.

26. The method as claimed in claim 25, wherein the moving step is completed before the step of bending the rib wire between the first and second dies is completed.

27. The method as claimed in claim 25, wherein the deflecting surface has a position adjacent to the first and second dies, the method further comprising adjusting the position of the deflecting surface prior to bending the leg of the rib wire into contact with the deflecting surface.

28. The method as claimed in claim 16, further comprising:

repeating the feeding through the passing steps to attach a desired number of clamps to the spine wire for one ring;

repeating the feeding through the passing steps to attach at least one additional clamp to the spine wire; and then cutting the spine wire .

29. The method as claimed in claim 28, wherein cutting the spine wire occurs at a different time than increasing compression of the spine and rib wires and passing electrical current through the electrodes and through the spine and rib wires.

30. The method as claimed in claim 28, wherein cutting the spine wire occurs prior to increasing compression of the spine and rib wires and prior to passing electrical current through the electrodes and through the spine and rib wires.

31. The method as claimed in claim 16, further comprising:

moving a cutoff block to a position adjacent to a cutoff lever;

pressing the cutoff block against the cutoff lever during movement of the first die toward the second die; and pivoting the lever to cut the spine wire by pressing the cutoff block against the cutoff lever.

32. The method as claimed in claim 16, further comprising cutting the rib wire between a cutoff block and one of the first and second dies.

33. The method as claimed in claim 32, wherein the rib wire is cut during movement of the first die toward the second die.

34. The method as claimed in claim 16, further comprising maintaining a substantially constant biasing force separating the first and second dies through a range of motion of the first die.

35. A clamp ring manufacturing apparatus for coupling a rib wire having at least one leg to a spine wire and for forming ribs from the rib wire, the clamp ring manufacturing machine comprising:

a first die;

a second die spaced a sufficient distance from the first die to receive the rib and spine wires;

an actuator coupled to the first die for moving the first die with respect to the second die to a position in which the rib is bent between the first and second dies, the first and second dies having surfaces cooperating with one another to bend a leg of the rib wire through an angle; and a leg deflecting surface located adjacent to the first and second dies, the leg deflecting surface positioned to contact the leg of the rib wire in a range of relative positions of the first and second die assemblies.

36. The apparatus as claimed in claim 35, further comprising at least one die post and collar assembly coupled to the first and second dies, each die post and collar assembly having a die post axially movable within a collar to guide the first die and to resist torque forces generated by the dies.

37. The apparatus as claimed in claim 35, further comprising a die plate coupled to the first die, wherein the leg deflecting surface is a surface of an element coupled to the die plate at a position adjacent to the first and second dies.

38. The apparatus as claimed in claim 37, wherein the position of the element on the die plate is adjustable.

39. The apparatus as claimed in claim 35, wherein the deflecting surface has an position that is adjustable with respect to the first and second dies.

40. The apparatus as claimed in claim 35, wherein the deflecting surface is located a distance away from the first and second dies sufficient to permit the leg of a rib wire to leave contact with the deflecting surface at least in the angle bent by the first and second dies.

41. The apparatus as claimed in claim 35, further comprising an electrode associated with each die, at least one of the electrodes movable toward and away another of the electrodes.

42. The apparatus as claimed in claim 35, further comprising a first electrode coupled to the first die, wherein the first electrode is movable into and out of contact with at least one of the rib and spine wires by the actuator.

43. The apparatus as claimed in claim 35, further comprising:

at least one spine wire guide surface positioned to guide spine wire to the first and second dies; and at least one rib wire guide surface positioned to guide rib wire to the first and second dies in a non-orthogonal relationship with respect to the spine wire.

44. The apparatus as claimed in claim 35, further comprising a spring positioned to exert a biasing force separating the first and second dies.

45. A method of manufacturing a clamp ring, comprising:

feeding a spine wire between a first die and a second die;

feeding a rib wire between the first die and the second die;

moving the first die toward the second die;

bending a leg of the rib wire between the first and second dies by moving the first die toward the second die;

sweeping the leg of the rib wire past a deflecting surface located adjacent to the first and second dies to deflect the leg while the leg is being bent; and attaching the rib wire to the spine wire.

46. The method as claimed in claim 45, wherein:

the rib wire is bent into a U-shape; and the leg is bent out of a plane defined by a remainder of the rib wire.

47. The method as claimed in claim 45, wherein sweeping the leg of the rib past the deflecting surface includes bending the leg into and out of contact with the surface.

48. The method as claimed in claim 45, further comprising bending the leg out of contact with the deflecting surface prior to attaching the rib wire to the spine wire.

49. The method as claimed in claim 45, wherein the deflecting surface has a position adjacent to the first and second dies, the method further comprising adjusting the position of the deflecting surface to change an amount of deflection of the leg.

50. The method as claimed in claim 45, further comprising guiding the first die toward the second die via a die post and collar assembly coupled to the first and second dies, wherein a die post is movable within and guided by a collar during movement of the first die toward the second die.

51. The method as claimed in claim 45, wherein attaching the rib wire to the spine wire includes holding the rib and spine wires together between welding electrodes.

52. The method as claimed in claim 51, wherein attaching the rib wire to the spine wire occurs after bending the leg of the rib wire.

53. The method as claimed in claim 51, wherein the first die is moved and the rib and spine wires are held together by force from one actuator.

54. The method as claimed in claim 45, further comprising controlling pressure on the rib and spine wires by a spring exerting a biasing force pushing the first and second dies away from one another.

55. The method as claimed in claim 45, wherein the first and second dies are part of first and second die assemblies, respectively, the method further comprising installing the first and second die assemblies as a single unit into a machine frame prior to the feeding, moving, bending, sweeping, and attaching steps.

56. The method as claimed in claim 45, further comprising cutting the rib wire prior to sweeping the leg of the rib wire past the deflecting surface.

* * * * *